US008157093B2

(12) United States Patent
Ishikawa et al.

(10) Patent No.: US 8,157,093 B2
(45) Date of Patent: Apr. 17, 2012

(54) PACKING UNIT

(75) Inventors: Sakae Ishikawa, Yokohama (JP); Hideyuki Goda, Yokohama (JP); Hirofumi Sugane, Machida (JP); Tomoaki Arai, Yamato (JP); Satoshi Ishihara, Satte (JP); Tsuyoshi Abe, Tokyo (JP); Moku Naruishi, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 787 days.

(21) Appl. No.: 12/219,173

(22) Filed: Jul. 17, 2008

(65) Prior Publication Data

US 2009/0025342 A1 Jan. 29, 2009

(30) Foreign Application Priority Data

Jul. 17, 2007 (JP) ..... 2007-185707
Sep. 14, 2007 (JP) ..... 2007-239717
Dec. 12, 2007 (JP) ..... 2007-320709

(51) Int. Cl.
*B65D 19/00* (2006.01)

(52) U.S. Cl. ..... 206/386; 108/51.11

(58) Field of Classification Search ..... 206/386, 206/599; 108/51.11, 55.3, 55.1; 238/10 E; 248/346.06; 269/309, 310, 13
See application file for complete search history.

(56) References Cited

U.S. PATENT DOCUMENTS 3,933,101 A * 1/1976 Blas ..... 410/69
4,234,278 A * 11/1980 Harshman et al. ..... 410/69
4,565,343 A * 1/1986 Lake et al. ..... 248/346.06
4,676,705 A * 6/1987 Kuster et al. ..... 410/80
6,293,400 B1 9/2001 Arai et al.
6,488,457 B2 * 12/2002 Diamante ..... 410/84
6,565,299 B1 * 5/2003 Guilbault et al. ..... 410/69
6,602,032 B2 * 8/2003 Arai ..... 410/46
7,758,290 B2 * 7/2010 Boggenstall et al. ..... 410/80
2002/0008048 A1 * 1/2002 Ishikawa et al. ..... 206/600
2006/0144302 A1 * 7/2006 Arai et al. ..... 108/53.1
2006/0226046 A1 * 10/2006 Matsumoto et al. ..... 206/597

FOREIGN PATENT DOCUMENTS

EP 1547931 6/2005
JP 09-150831 6/1997
JP 2000-326153 11/2000
JP 2001-055232 2/2001
JP 2001-055235 2/2001

(Continued)

OTHER PUBLICATIONS

Office Action for Chinese patent Application No. 2008101316133 dated Jan. 15, 2010.

(Continued)

*Primary Examiner* — Luan K Bui
*Assistant Examiner* — Rafael Ortiz
(74) *Attorney, Agent, or Firm* — Harness, Dickey & Pierce, P.L.C.

(57) ABSTRACT

A packing unit includes a pallet, a structural base, and a fixing device. The pallet mounts an article thereon. The structural base has a fixed portion and is detachably attached to the article. The fixing device fixes the article to the pallet and includes an article fixing member slidably supported by the pallet. The article fixing member is movable between a fix position at which the article fixing member is engaged with the fixed portion of the structural base of the article to fix the article to the pallet and a release position at which the engagement of the article fixing member and the fixed portion is released.

6 Claims, 37 Drawing Sheets

FOREIGN PATENT DOCUMENTS

| | | |
|---|---|---|
| JP | 2002-264815 | 9/2002 |
| JP | 2003-182736 | 7/2003 |
| JP | 2004-099070 | 4/2004 |
| JP | 3648904 | 2/2005 |
| JP | 2005-186939 | 7/2005 |
| JP | 2007-062801 | 3/2007 |
| WO | WO 2007/062382 | 5/2007 |

OTHER PUBLICATIONS

Abstract of JP 10-218182 published Aug. 18, 1998.

* cited by examiner

PACKING UNIT

PRIORITY STATEMENT

The present patent application claims priority under 35 U.S.C. §119 from Japanese Patent Application Nos. 2007-185707, filed on Jul. 17, 2007; 2007-239717, filed on Sep. 14, 2007; and 2007-320709, filed on Dec. 12, 2007 in the Japan Patent Office, the entire contents of each of which are hereby incorporated herein by reference.

BACKGROUND

1. Field

The present invention relates to a packing unit to pack an article such as a copier, a printer, a facsimile machine, or any other image forming apparatus for transport and delivery.

2. Description of the Background

Conventionally, corrugated cardboards or other such packing materials are used to pack various types of articles or products for transport and delivery. After unpacking, such conventional packing materials may be stored by users or discarded as waste.

Recently, reuse of such packing materials has come to be encouraged in an effort to reduce consumption and save resources. However, a problem with such conventional packing materials including corrugated cardboard is that they are not very durable and thus are unsuitable for reuse for transporting or storing articles.

Although packing materials made of resin or metal may be suitable for reuse, they may need to be prepared in accordance with a variety of shapes and sizes of different articles. As a result, the design and/or storage of such members may need more efforts, thereby resulting in cost increase.

At the same time, a conventional type of hand truck on wheels may be used to load an article readied for transport and delivery. Such conventional hand truck is reusable and capable of loading a variety of apparatuses or products of different shapes and sizes. However, only loading an article on such conventional hand truck may not provide a sufficient stability, which may result in damage or breakage of the article during transport.

As a result, a conventional type of rack may be used to prevent an article from being damaged during transport and to load and pack the article more securely. Such conventional rack may be used to pack a copier, a printer, a facsimile machine, or any other image forming apparatus for transport and delivery, and is reusable and can be disassembled after delivery so as to be efficiently transported and stored.

However, for such conventional type of rack, a cover for covering an upper face of an image forming apparatus is latched on a pallet via a pulling member. Consequently, a relatively great load may be applied to the article when the article is vibrated or bounced during transport, which may result in a damage to a top-mounted scanner unit or other member. In particular, when such article has an auto-document feeder (ADF) on its upper face, such ADF may have a relatively complicated shape. Consequently, the article may be prevented from being securely fixed, for example, in a vertical direction.

Another conventional type of rack may be capable of securely positioning an article when loading it. However, such conventional type of rack may support the article by holding its side faces with spacers attached at supports. As a result, when the article is bounced due to shock during transport, a relatively great load might be applied to the article.

SUMMARY

Example embodiments of the present invention provide a packing unit capable of fixing an article on a pallet while preventing the article from bouncing on the pallet and compatible with a relatively wide variety of articles.

In one example embodiment of the present invention, a packing unit includes a pallet, a structural base, and a fixing device. The pallet mounts an article thereon. The structural base is detachably attached to the article and has a fixed portion. The fixing device fixes the article to the pallet and includes an article fixing member slidably supported by the pallet. The article fixing member is movable between a fix position at which the article fixing member is engaged with the fixed portion of the structural base of the article to fix the article to the pallet and a release position at which the engagement of the article fixing member and the fixed portion is released.

In another example embodiment of the present invention, a packing unit includes a pallet, a structural base, and a fixing device. The pallet has an article mount face to mount an article thereon. The structural base is detachably attached to the article and has a fixed portion. The fixing device fixes the article to the pallet. The fixing device includes a fixing member and a moving mechanism. The fixing member formed in a hook shape is engageable with the fixed portion of the structural base to fix the article to the pallet. The moving mechanism moves the fixing member between an article fix position at which the fixing member is engaged with the fixed portion and a storage position at which the fixing member is stored in the pallet. The moving mechanism projects the fixing member from the pallet and moves the fixing member substantially parallel to the article mount face of the pallet to shift the fixing member to the article fix position.

In still another example embodiment of the present invention, a packing unit includes a pallet and a fixing device. The pallet mounts an article thereon. The fixing device directly fixes the article to the pallet. The fixing device includes a stationary fixing member and a movable fixing member. The stationary fixing member has a hook shape and is fixed to the pallet. The movable fixing member has a hook shape and is engageable at an article fix position at which the movable fixing member is projected from the pallet and at a storage position at which the movable fixing member is stored in the pallet.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein:

FIG. 22 is a perspective view of the pallet in which the fixing device is seen through;

Figure 1:
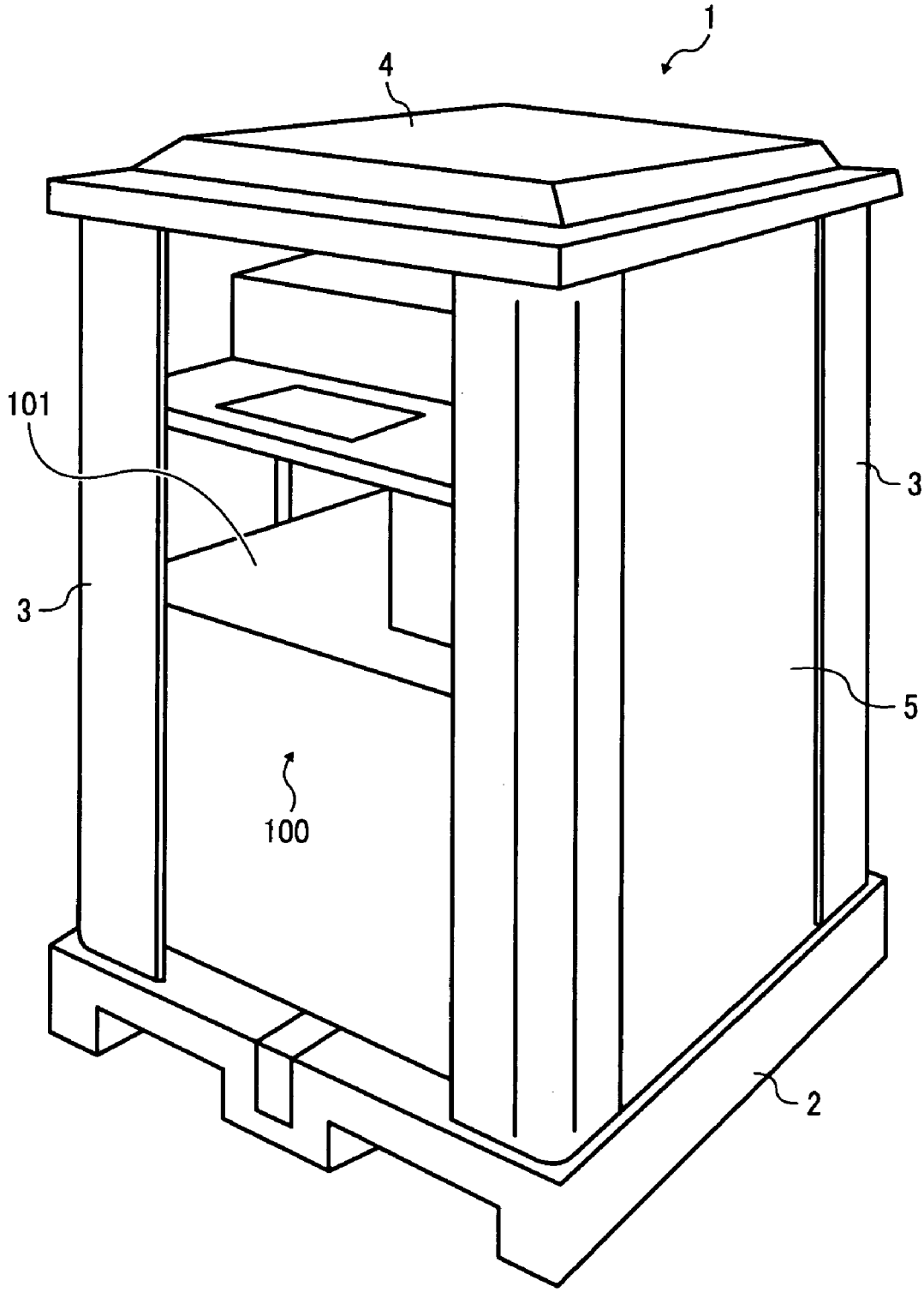
FIG. 1 is a perspective view illustrating a state in which an article is packaged by a packing unit according to a first example embodiment of the present disclosure.

The accompanying drawings are intended to depict example embodiments of the present disclosure and should not be interpreted to limit the scope thereof. The accompanying drawings are not to be considered as drawn to scale unless explicitly noted.

DETAILED DESCRIPTION OF EXAMPLE EMBODIMENTS

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve the same results.

While example embodiments of the invention are capable of various modifications and alternative forms, embodiments thereof are shown by way of example in the drawings and will herein be described in detail. It should be understood, however, that there is not intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like may be used herein to facilitate description of one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors herein interpreted accordingly.

Although the terms first, second, etc., may be used herein to describe various elements, components, regions, layers, and/or sections, it should be understood that these elements, components, regions, layers, and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to limit the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

FIG. 1 is a perspective view illustrating a state in which an article is packed by a packing unit according to a first example embodiment of the present disclosure.

Figure 2:
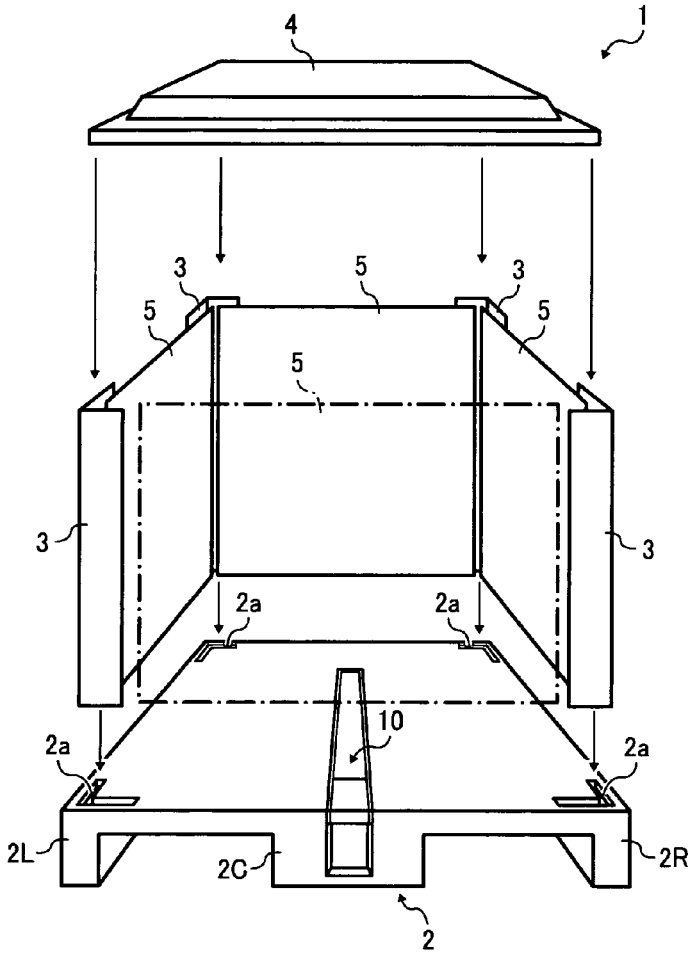
FIG. 2 is an exploded view schematically illustrating a configuration of the packing unit.

FIG. 2 is an exploded view schematically illustrating a configuration of the packing unit.

As illustrated in FIGS. 1 and 2, the packing unit 1 has a pallet 2, four supports 3 fitted to the four corners of the pallet 2 so as to stand on the pallet 2, a top 4 mounted on the supports 3, and four side walls 5 disposed between adjacent pairs of the supports 3. In FIG. 1, a front one of the side walls 5 is omitted so that the article 100 inside the packing unit 1 is visible.

For the packing unit 1, each of the pallet 2, the supports 3, the top 4, and the side walls 5 may include a resin material such as PP (polypropylene), ABS (acrylonitrile butadiene styrene), or PE (polyethylene) in view of cost, weight, productivity, strength, and/or operability.

Preferably, the supports 3 are produced by integral molding (e.g. extrusion molding) using resin. The side walls 5 serves as a tension member between each adjacent pair of the supports 3 to provide a certain degree of strength to such case structure. Accordingly, in view of ease of unpacking, preferably the side walls 5 are formed with a resin cardboard having a relatively light weight and great strength.

In FIG. 2, the pallet 2 has three beams, that is, a left beam 2L, a central beam 2C, and a right beam 2R at its left-end, middle, right-end portions, respectively. Between the beams 2L, 2C, and 2R are formed insertion openings into which a fork of a forklift is insertable.

At the four corners of the top face of the pallet 2 are provided fitting portions 2*a* into which the supports 3 are fitted. At a middle portion of the top face of the pallet 2 is provided a fixing device 10 for fixing an article on the pallet 2.

Although the fixing device 10 of FIG. 2 is disposed substantially parallel to an extending direction of each beam of the pallet 2, it should be noted that the fixing device 10 may be disposed substantially perpendicular to the extending direction of each beam. Further, although the fixing device 10 of FIG. 2 is provided to a portion of the central beam 2C of the pallet 2, it should be noted that the fixing device 10 may be disposed outside the above-described beam portions.

The top 4 is mounted on the supports 3 to cover the article mounted on the pallet 2. The top 4 is detachably connected to the supports 3 via lock members made of a resin, for example. The lock members may have any suitable configuration as needed, and therefore an illustration and explanation thereof is omitted here. By connecting and fixing the top ends of the supports 3 to the top 4, the packing unit 1 is positioned and fixed with respect to four directions. Simultaneously, the upper edges of the side walls 5 are guided, thereby preventing a body part of the packing unit 1 from being swollen or contracted.

The supports 3 has a substantially L-shaped cross section. The supports 3 are fitted into the fitting portions 2*a* of the pallet 2 and the side walls 5 are disposed between the supports 3, thereby providing a sufficient self-supportability or structural stiffness. Guide grooves are vertically provided at both side edges of each support 3 in the sectional direction so as to fit with corresponding edges of the side walls 5. When the side walls 5 are slid between the supports 3, the supports 3 are fixedly supported.

Figure 3:
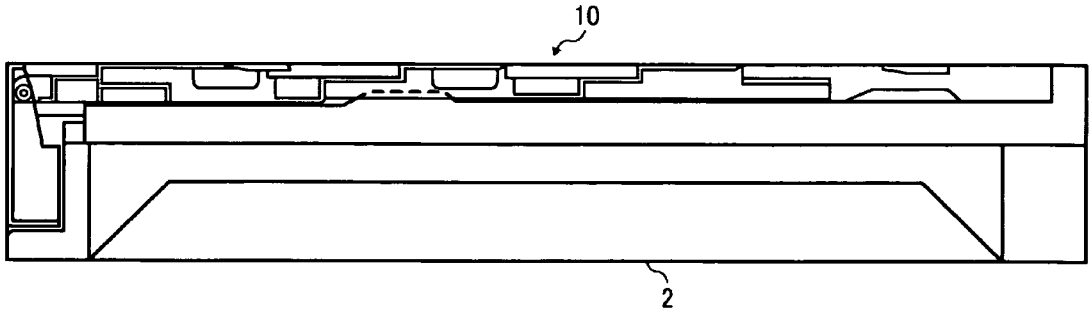
FIG. 3 is a sectional view of a pallet.

FIG. 3 is a sectional view of the pallet 2 and more specifically a sectional view of a central beam 2C to which the fixing device 10 is provided. In FIG. 3, it is difficult to distinguish the fixing device 10 from a main body of the pallet 2. Therefore, in FIGS. 4A to 4C, the fixing device 10 is illustrated separately from the main body of the pallet 2.

Figure 4A:
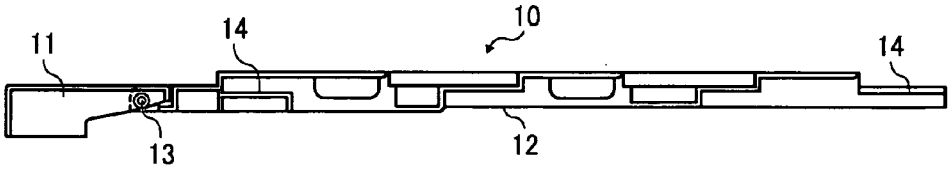
FIGS. 4A to 4C are sectional views separately illustrating a fixing device and a main body of the pallet.
Figure 4B:
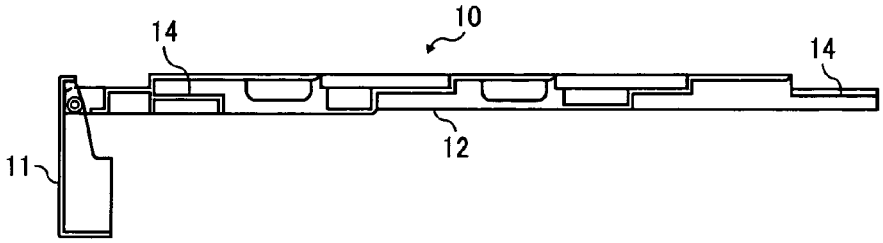
Figure 4C:
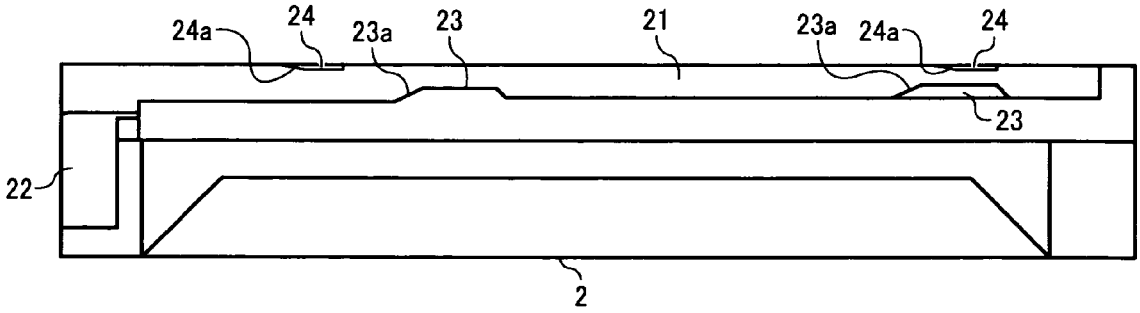

As illustrated in FIGS. 3, 4A, 4B, and 4C, the fixing device 10 has a lever 11 serving as an operation member and a stay 12 (e.g., a base lock) serving as an article fixing member. The lever 11 and the stay 12 are pivotably connected with a shaft 13. The fixing device 10 is placed at a fixing-member set portion 21, in which the stay is mounted to the main body of the pallet 2, so as to be movable in the beam extending direction within the fixing-member set portion 21. As illustrated in FIGS. 3 and 4B, when an article is not fixed to the fixing device 10, the lever 11 may be folded at a substantially right angle relative to the stay 12 and placed into a lever receive portion 22 of the pallet 2 serving as an operation-member receive portion. The lever receive portion 22 is opened toward the front side of the pallet 2, that is, the left side in FIGS. 4A, 4B, and 4C so that an operator can handle the lever 11 by putting his/her hand onto an opening portion 16 of FIG. 11.

In the present example embodiment, the fixing-member set portion 21 of the pallet 2 is formed at the main body of the pallet 2 in a groove shape. The stay 12 is fitted with the fixing-member set portion 21 having such groove shape, so that the stay 12 is slidably supported by the fixing-member set portion 21. In the present example embodiment, the lever 11 is also movable within the fixing-member set portion 21. For example, when the lever 11 and the stay 12 are shifted from such folded state to an extended state or vice versa, the lever 11 is moved within the fixing-member set portion 21. The fixing-member set portion 21 has two convex portions 23. Each convex portion 23 has a guide slant 23*a* on the side of the front face of the pallet 2, that is, the side of the lever 11. When the lever 11 and the stay 12 are linearly extended as illustrated in FIG. 4A, the stay 12 is guided by the guide slant 23*a* to run onto the convex portions 23.

Figure 5A:
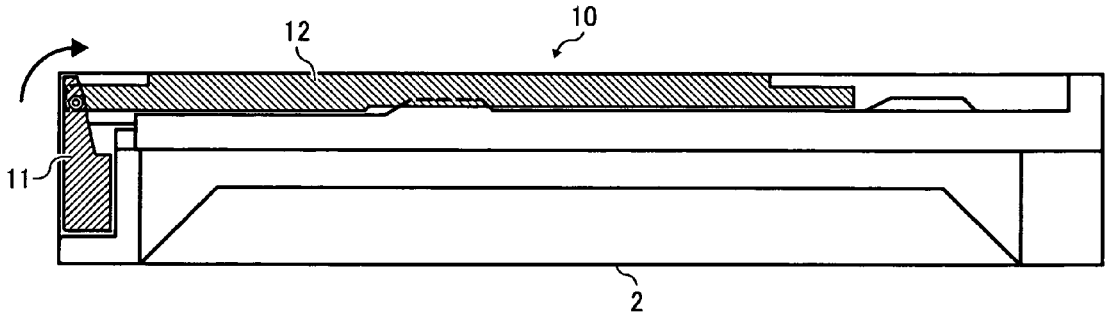
FIGS. 5A and 5B are schematic views for explaining a movement of the fixing device.
Figure 5B:
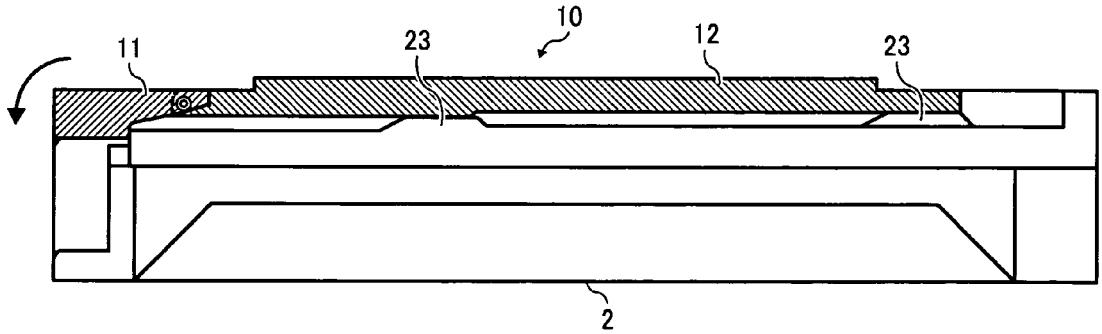

FIGS. 5A and 5B illustrate movements of the fixing device 10.

As illustrated in FIG. 5A, when the fixation of the fixing device 10 is released, the lever 11 and the stay 12 are folded around the shaft. In such state, the stay 12 is placed outside the convex portions 23 so that the upper face of the fixing device 10 or the stay 12 is substantially leveled to or forms a single plane together with the upper face of the main body of the pallet 2. From such state, when the stay 12 is pushed toward the rear side of the pallet 2, that is, the right side of FIG. 5A by operating the lever 11 as indicated by an arrow in FIG. 5A, the stay 12 is run on the convex portions 23 and thus pushed upward by a height of convex portions 23 as illustrated in FIG. 5B. As a result, a portion of the fixing device 10 or the stay 12 is projected from the upper face of the main body of the pallet 2. In such state of FIG. 5B, the article, which is placed on the pallet 2, is fixed by the fixing device 10. Such fixing operation of the article is described later in detail.

Figure 9:
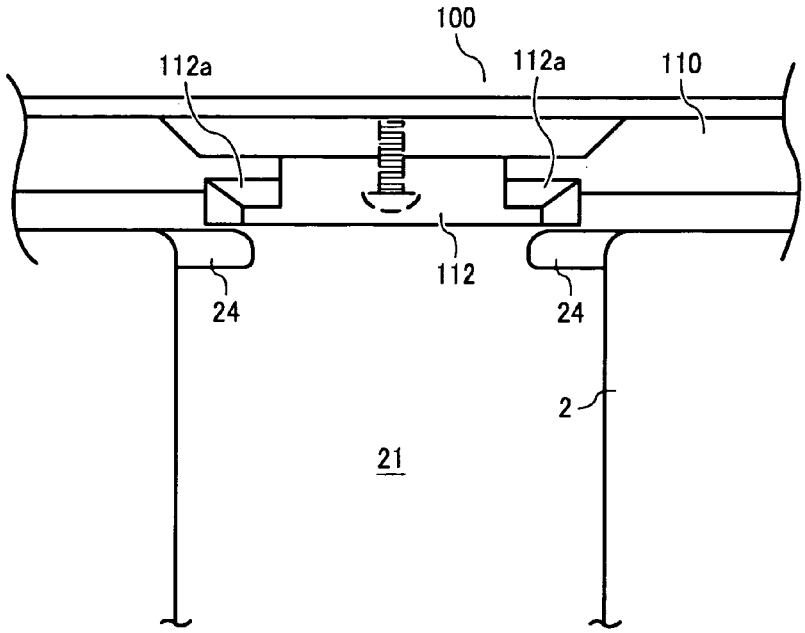
FIG. 9 is a front view illustrating one of the fixed portions of the article viewed from a front-face side of the pallet.

The fixing-member set portion 21 of the pallet 2 has projections 24 on its front and rear sides. As illustrated in FIG. 9, the upper portion of the fixing-member set portion 21 is opened, and the fixing-member set portion 21 is formed in a groove shape. The projections 24 are provided so as to project inward from the side walls of the fixing-member set portion 21.

Figure 6:
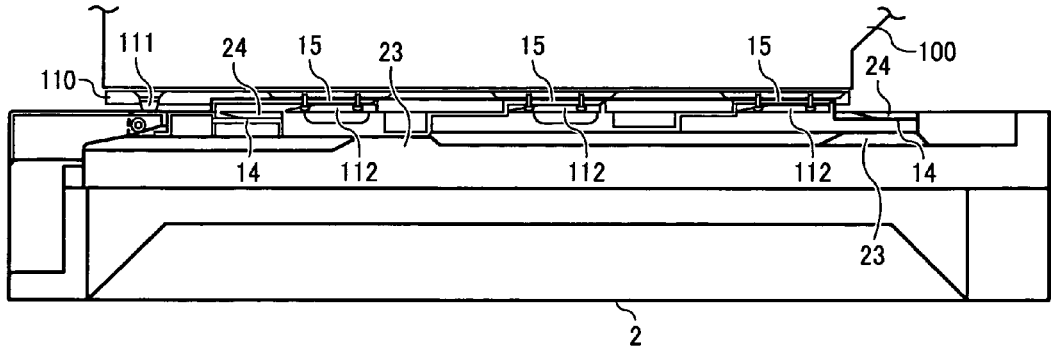
FIG. 6 is a sectional view illustrating a state in which an article is fixed on the pallet.

On the other hand, the fixing device 10 has engaging portions 14 at its front and rear sides as illustrated in FIGS. 4A, 4B, and 6. The engaging portions 14 engage with the corresponding projections 24 when the fixing device 10 moves to the fixing position (see FIGS. 7 and 10). The engaging portions 14 at the front side are dented inward from either wall face of the stay 12 (see FIGS. 7 and 10). The engaging portions 14 at the rear side are provided at a rear end portion of the stay 12. As described above, when an operation of the lever 11 pushes the stay 12 backward and upward, the projections 24 of the pallet 2 are engaged with the engaging portions 14 of the fixing device 10, thereby holding down the fixing device 10 or the stay 12 from above (see FIGS. 6 and 10). Thus, as illustrated in FIG. 6, the fixing device 10 in such fixed state is held by the projections 24 and the convex portions 23 of the pallet 2 from above and below, so that the fixing device 10 is securely fixed to the main body of the pallet 2. Each projection 24 has a guide slant 24*a* on the side of the front face of the pallet 2, that is, the side of the lever 11 so that the engaging portions 14 may smoothly engage with the projections 24 when the stay 12 moves toward the rear side of the pallet 2.

Figure 7:
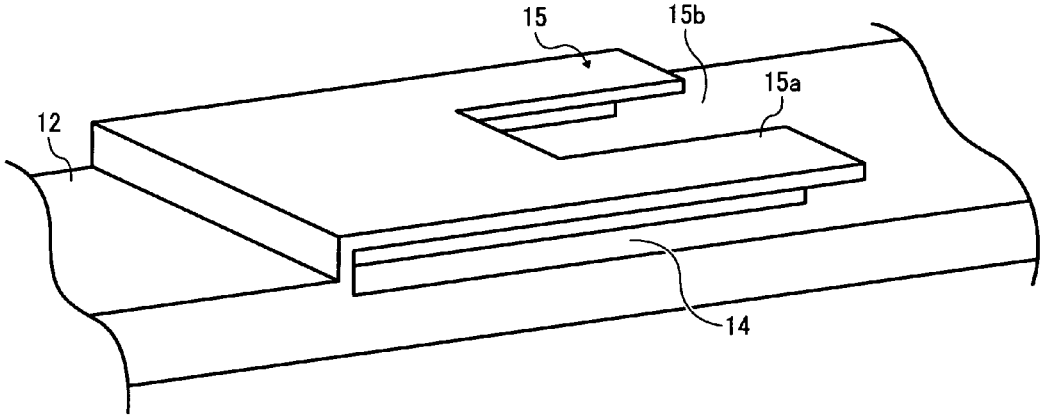
FIG. 7 is a partial perspective view illustrating a fitting portion provided at a fixing member.

As illustrated in FIG. 6, the stay 12 of the fixing device 10 has fitting portions 15 at three points to fix an article. As illustrated in FIG. 7, each fitting portion 15 has an opening portion 15*b*. The opening portion 15*b* is formed by cutting a portion of a ceiling face 15*a* so as to be opened toward the rear side of the pallet 2, that is, the side opposite the side of the lever 11. The ceiling face 15*a* on either side of the opening portion 15*b* throws out or overhangs inward to form an engaging portion engaged with an attachment lock 112, described below.

Figure 8:
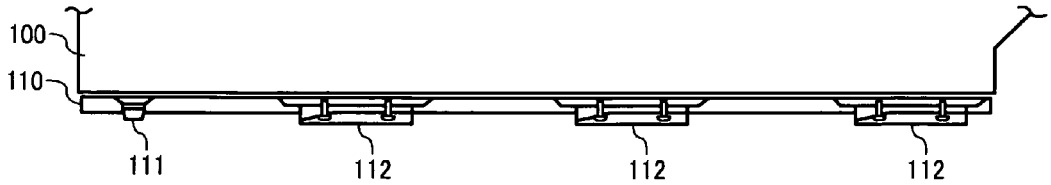
FIG. 8 is a sectional view illustrating fixed portions of the article.
Figure 10:
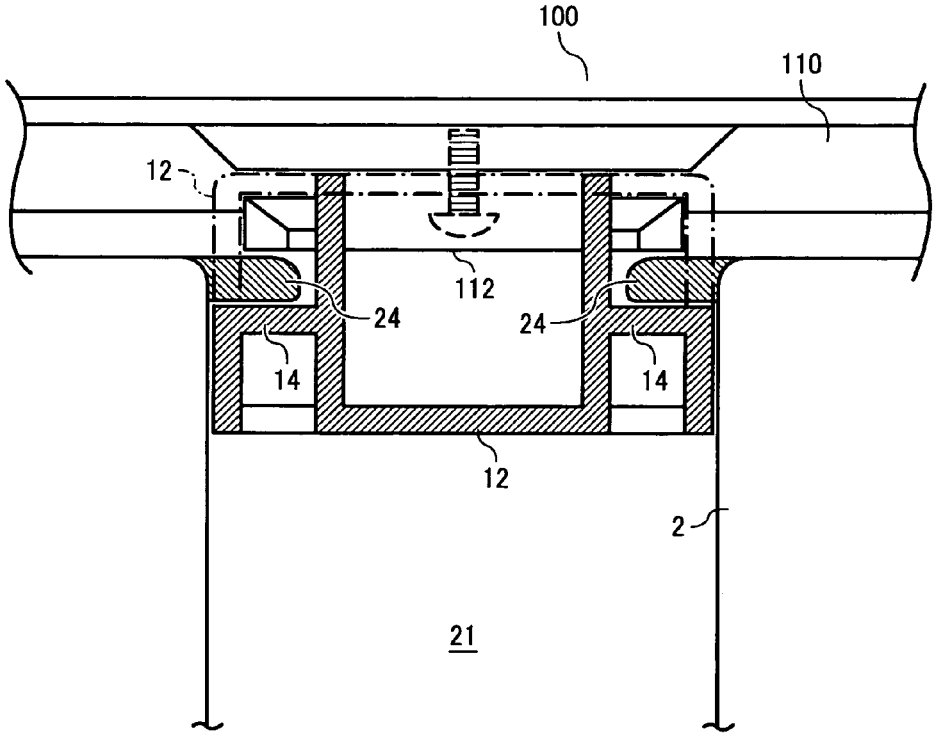
FIG. 10 is a partial sectional view illustrating a state in which engaging portions on a front side of a stay are engaged with projections of the main body of the pallet.

As illustrated in FIG. 8, such three attachment locks 112 are fixed to an article base 110 with screws so as to be suspended from the bottom face of the article 100. FIG. 9 illustrates one of such attachment locks 112 when the article 100 is mounted on the pallet 2, seen from the front-face side of the pallet 2, although the fixing device 10 is omitted in FIG. 9. Each attachment lock 112 has fitting portions 112*a* on both sides in the width direction. When the stay 12 is moved backward and upward to fix the article 100, each fitting portion 15 of the fixing device 10 is fitted with the corresponding attachment lock 112 via the opening portion 15*b*. Simultaneously, the ceiling face 15*a* of each fitting portion 15 is fitted to the fitting portion 112*a* of the corresponding attachment lock 112, so that the article 100 is fixed to the pallet 2 by the fixing device 10. FIG. 6 illustrates such state in which the article 100 is fixed to the pallet 2. FIG. 10 illustrates a state in which the engaging portions 14 on the front side of the stay 12 are engaged with the projections 24 of the main body of the pallet 2.

For packing, the positions of the attachment locks 112 of the article 100 are adjusted to the position of the fixing device 10 of the pallet 2 so that the article 100 is mounted onto the pallet 2. When the lever 11 is operated to move the stay 12 toward the rear side of the pallet 2, the fixing device 10 is fixed to the article 100. For unpacking, when the lever 11 is operated so as to fold the lever 11 against the stay 12 and the stay 12 is moved toward the front side of the pallet 2, the fitting portions 15 are detached from the attachment locks 112 of the article 100, thereby releasing the fixation of the article 100 by the fixing device 10. In the present example embodiment, the fixing device 10 is disposed on a middle portion in the width direction of the pallet 2, thereby facilitating such positioning of an article. Further, such an article mount position may be marked on the mount face of the pallet 2, thereby further facilitating such positioning of the article.

Thus, according to the present example embodiment, the packing unit 1 has the fixing device 10 to fix an article directly to the pallet 2. Such configuration can prevent the article from bouncing due to vibration or shock during transport, thereby preventing the article from being damaged or broken down due to excessive load. Further, the fixing device 10 allows the fixing and releasing of the article 100 to be carried out by a relatively simple operation, thereby allowing the article 100 to be simply and securely fixed to the pallet 2.

Figure 11:
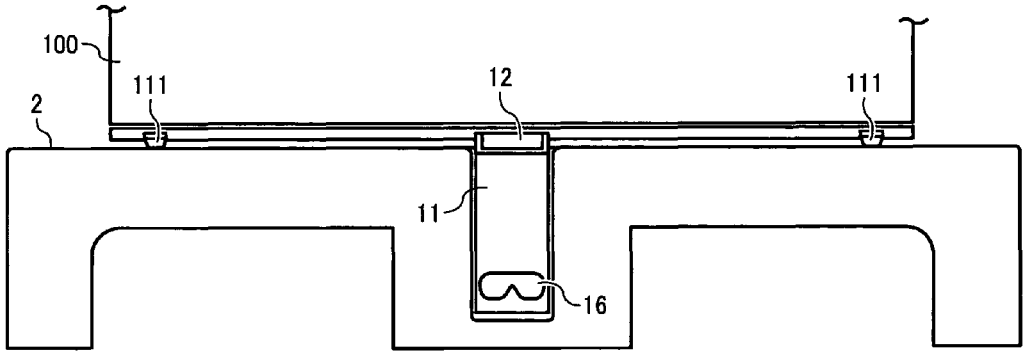
FIG. 11 is a front view illustrating the pallet on which the article is mounted.

FIG. 11 is a front view illustrating a state in which the article 100 is mounted on the pallet 2 and fixed by the fixing device 10. The load of the article 100 is supported in a manner that the weight of the article 100 is received via rubber feet 111 by a strong portion of the main body of the pallet 2, at which the fixing device 10 is not placed. The bottom faces of the attachment locks 112 fixed to the article base 110 are substantially leveled to the bottom faces of the rubber feet 111, which are under the load of the article 100, so as not to project downward (see FIG. 6). Such configuration can facilitate operations of putting the article 100 down from the pallet 2 and setting the article 100 to a setting position. Such configuration also allows the rubber feet 111 and the attachment locks 112 to receive shock during transport, thereby dispersing such shock.

In the present example embodiment, the fixing device 10 is provided to the central beam portion of the pallet 2. Thus, the fixing device 10 can be disposed on the pallet 2 without reducing the rigidity and/or strength of the pallet 2. It should be noted that the location of the fixing device 10 is not limited to the central beam portion but may be located to any other suitable portion of the pallet 2. For example, the fixing device 10 may be disposed in a direction perpendicular to the beams. It should also be noted that the number of fixing members (e.g., fixing devices 10) is not limited to one but may be two or more. For example, two fixing members may be disposed on both sides of the pallet 2 in the width direction, that is, the horizontal direction of FIG. 10. Alternatively, three fixing members may be disposed on the side portions and the central beam portion of the pallet 2.

Figure 12:
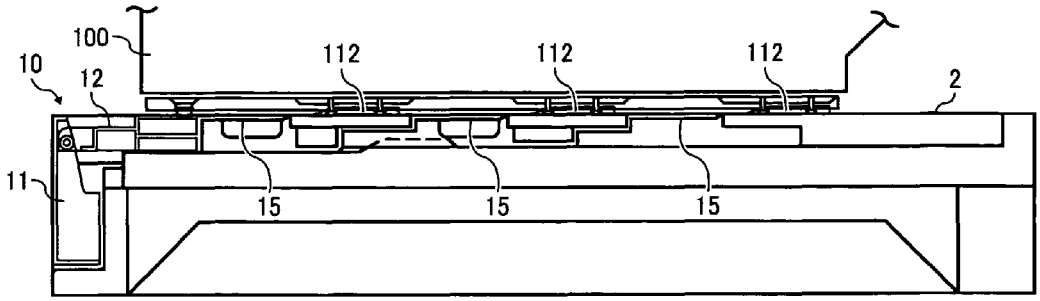
FIG. 12 is a sectional view illustrating a state in which the fixation of the article by the fixing device is released.

FIG. 12 is a sectional side view illustrating a state in which the fixation of the article 100 by the fixing device 10 is released. In the fixed state of the article 100 as illustrated in FIG. 6, when the lever 11 is operated as described for FIG. 5, the stay 12 is moved forward (that is, toward the left side of FIG. 12) and downward. As a result, the engagement between the attachment locks 112 and the fitting portions 15 of the stay 12 are disengaged, thereby releasing the fixation of the article 100. Thus, the article 100 can be easily put down from the pallet 2. At this time, the fixing device 10 is stored in the main body of the pallet 2 and the stay 12 is not projected from the upper face of the pallet 2, thereby facilitating operations such as relocation of the article.

Next, a description is given of a pallet serving as the mount base of a packing unit according to a second example embodiment.

Figure 13:
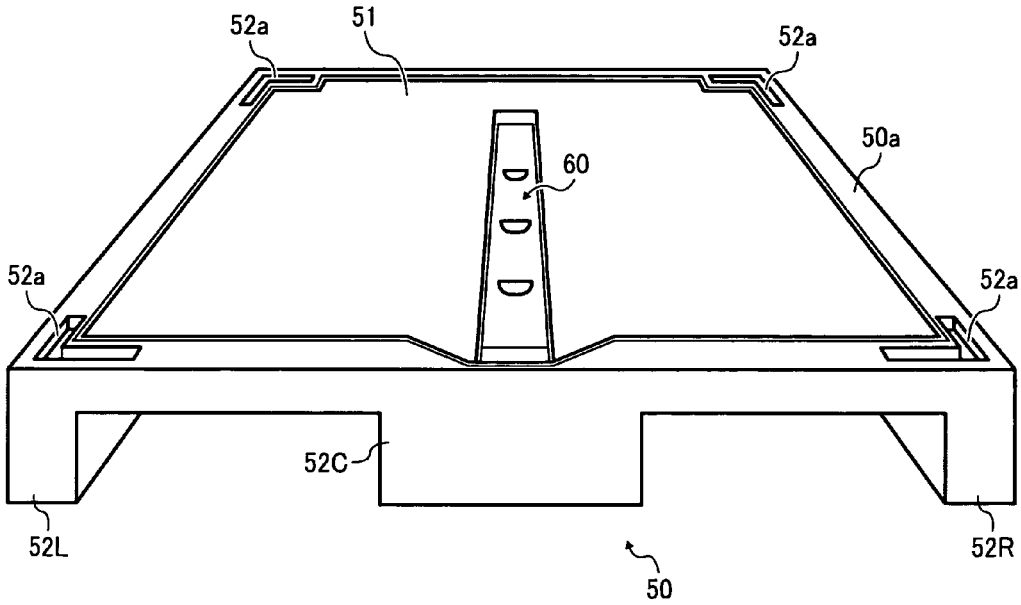
FIG. 13 is a schematic perspective view illustrating a pallet according to the second example embodiment viewed from above on a front side of the pallet.

FIG. 13 is a schematic perspective view illustrating a pallet 50 according to the second example embodiment. The pallet 50 of FIG. 13 has on its upper face a recessed portion 50*b* (see FIG. 14), which is formed by denting an interior portion of an outer peripheral portion 50*a*. A backing plate 51 is fitted to the recessed portion 50*b*. The backing plate 51 is configured so that the upper face of the backing plate 51 is substantially leveled to the upper face of the pallet 50, that is, the upper face of the outer peripheral portion 50*a*. At the four corners of the outer peripheral portion 50*a* are provided fitting portions 50*a* to mount supports 3, which have the same configuration as in FIG. 3. Similar to the first example embodiment, the pallet 50 has three beams, that is, a left beam 52L, a central beam 52C, and a right beam 52R at its left-end, middle, right-end portions, respectively. Between the beams 52L, 52C, and 52R are formed insertion openings into which a fork of a forklift is insertable.

A fixing device 60 is provided at a middle portion of the pallet 50 in the width direction, that is, the horizontal direction of FIG. 13 so as to be located on the central beam 52C. The backing plate 51 has a groove corresponding to the fixing device 60. An upper portion of the fixing device 60, disposed on the recessed portion 50*b* of the pallet 50, is projected toward the groove 50*b* so that the article can be fixed by the fixing device 60.

According to the second example embodiment, the fixing device 60 has a stay 62 but no lever, which is different from the fixing device 10 having the lever 11 and the stay 12 according to the first example embodiment. Similar to the stay 12 according to the first example embodiment, the stay 62 is formed in a thin plate shape and has engaging portions to engage with the pallet 50 and fitting portions to fix the article, which are described later.

Figure 14:
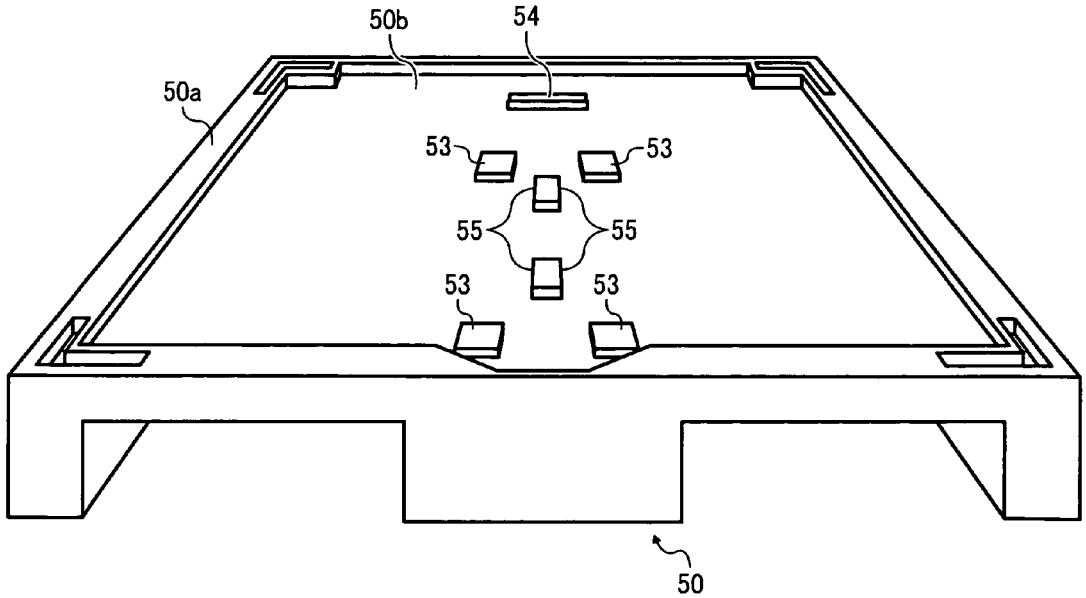
FIG. 14 is a schematic perspective view illustrating a state in which a backing plate is detached from the pallet of FIG. 13.

FIG. 14 is a schematic perspective view illustrating a state in which the backing plate 51 is detached from the pallet 50. The stay 62 having such thin plate shape is slidable forward and backward along the upper face of the recessed portion 50*b*. On the upper face of the recessed portion 50*b* are four guide members 53 to support the stay 62 in such slidable state. Further, at the rear side of the pallet 50 is a regulation member 54 to regulate a movable range of the stay 62 in the backward direction. Two lift members 55 are arranged at a middle portion of the ballet 50 in the width direction. In the second example embodiment, the guide members 53, the regulation member 54, and the lift members 55 are provided independently of the main body of the pallet 50 and separately mounted on the upper face of the recessed portion 50*b*. The guide members 53 and the regulation member 54 may be fixed with screws to the upper face of the recessed portion 50*b*. The lift members 55 may be fixed with click-type locks to the upper face of the recessed portion 50*b*.

Figure 15:
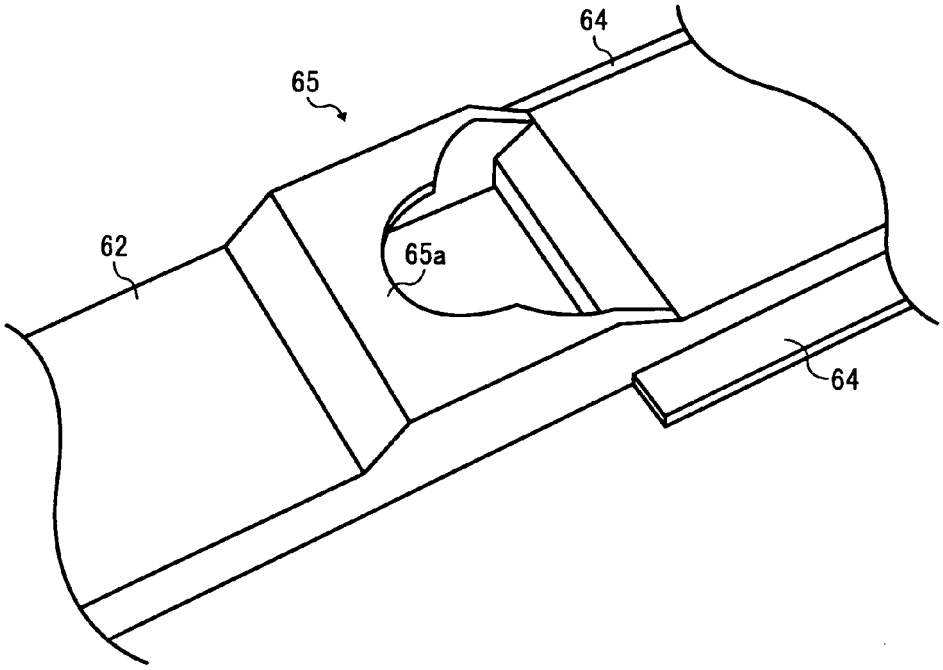
FIG. 15 is a partial perspective view illustrating engaging portions and fitting portions provided to a fixing member and their neighboring area.

FIG. 15 is a partial perspective view illustrating engaging portions 64 and fitting portions 65 of the stay 62 and their neighboring area. As illustrated in FIG. 15, the engaging portions 64 to hold the stay 62 or the fixing device 60 down against the main body of the pallet 50 are disposed so as to project from side faces of the stay 62. A description of the fitting portions 65 is given later.

Figure 16:
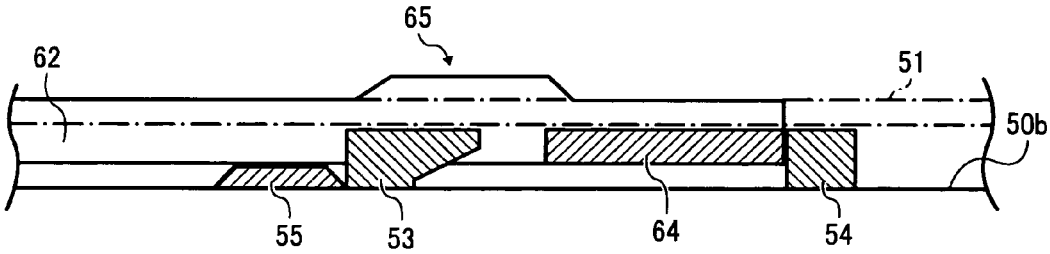
FIG. 16 is a sectional view illustrating a rear end portion of the fixing member at an article fixing position.
Figure 17:
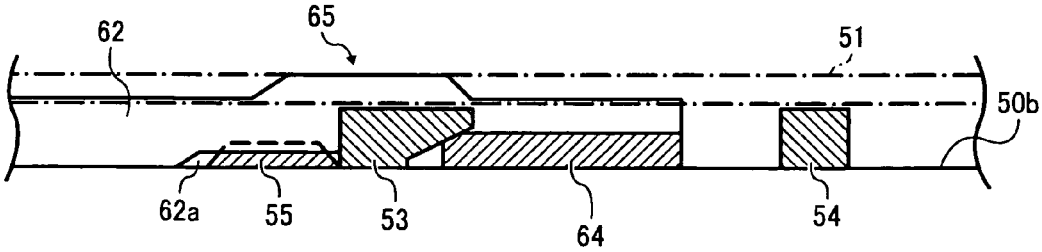
FIG. 17 is a sectional view illustrating the rear end portion of the fixing member at an article released position.

FIGS. 16 and 17 are sectional views illustrating the guide member 53, the lift member 55, and the regulation member 54 on the rear side of the pallet 50. FIG. 16 illustrates an article-fix position to which the stay 62 of the fixing device is moved backward and upward. FIG. 17 illustrates an article released position to which the stay 62 is moved forward and downward.

As illustrated in FIGS. 16 and 17, the guide member 53 has a guide slant on its rear side. When the stay 62 is moved forward, the guide slant is engaged with the engaging portion 64, which is provided so as to project from each side wall of the stay 62, to guide the engaging portion 64 downward. Thus, by holding the stay 62 down to the main body of the pallet 50, the upper face of the fitting portion 65 for fixing an article is substantially leveled to the upper face of the backing plate 51 to form a substantially single plane. Thus, the guide member 53 serves as a support member to guide the stay 62 from both sides in the width direction, and simultaneously serves as a holding member to hold the stay 62 down.

The lift members 55 have a trapezoidal cross section. The end face of each lift member 55 on its front side is formed as a guide slant. When the stay 62 is moved backward from the article released state of FIG. 17, a contact portion 62*a* of the stay 62 contacts the corresponding lift member 55, and the stay 62 is lifted along the guide slant of the lift member 55. As a result, as illustrated in FIG. 16, the stay 62 is moved onto the lift member 55, and thus the upper face of the fitting face 65 is projected from the upper face of the backing plate 51, thereby allowing the article to be fixed. At that time, a rear end portion of the stay 62 contacts the regulation member 54, so that a further backward movement of the stay 62 is regulated. Further, the engaging portion 64 of the stay 62 is held down by the backing plate 51, thereby preventing the stay 62 from slipping off upward. In the second example embodiment, the backing plate 51 is fixed to the main body of the pallet 50 so that the backing plate 51 is fitted to the recessed portion 50*b*. It should be noted that the backing plate 51 may be fixed to the main body of the pallet 50 with screws or the like.

Figure 18:
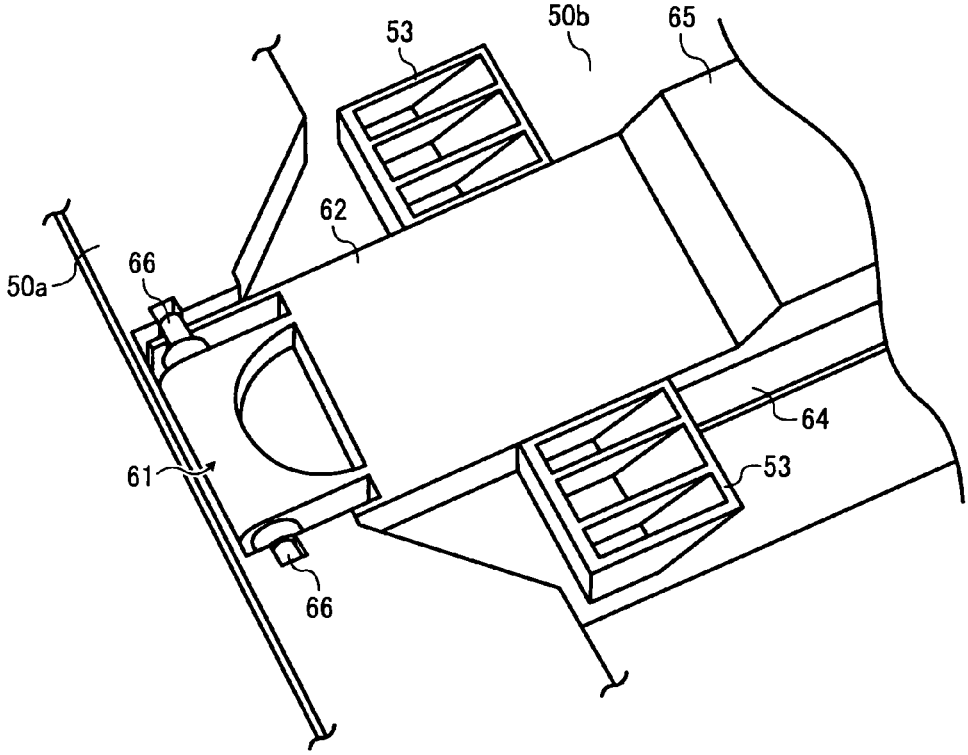
FIG. 18 is a partial perspective view illustrating a front end portion of a fixing device at the article released position.
Figure 19:
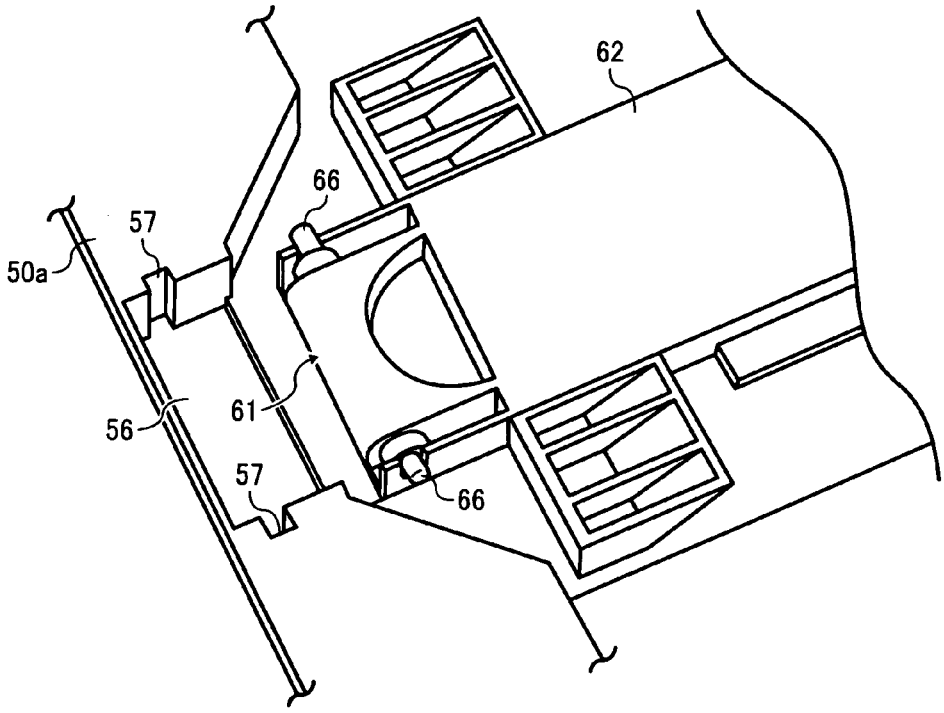
FIG. 19 is a partial perspective view illustrating the front end portion of the fixing device at the article-fix position.

FIGS. 18 and 19 are partial perspective views illustrating a front-end portion of the stay 62 of the fixing device 60 at the article-released position and the article-fix position, respectively.

As illustrated in FIGS. 18 and 19, a grip portion 61 is provided at the front-end portion of the stay 62. The grip portion 61 has a recess of a substantially semicircular shape on which an operator puts his/her hand to operate the stay 62. Further, engaging members 66 for engaging the stay 62 to the main body of the pallet 50 are mounted to and supported by the front end portion of the grip portion 61, that is, the front end portion of the stay 62. The engaging members 66 are provided so as to be projectable from and storable into the stay 62. The engaging members 66 are connected to an urging member (e.g., a compression spring), not illustrated, inside the stay 62. The urging member urges the engaging members 66 outward. Each engaging member 66 has a hemispherical shape at its exterior end portion and is configured so that a contact with a member can push the engaging member 66 into the stay 62. A longitudinal middle portion of the urging member, connected to the corresponding engaging member 66 at both end portions, is held by a rib, projected from the stay 62, within a concave portion formed on a back side of the front end portion of the stay 62.

At a portion of the main body of the pallet 50 corresponding to the front end portion of the stay 62 is provided a stay-end fitting portion 56 capable of fitting with the front end portion of the stay 62. On both sides of the stay-end fitting portion 56 are formed engaging recesses 57 for fitting with the stay-end fitting portion 56. In the article-released position of FIG. 18 in which the stay 62 is shifted to the front end portion of the stay 62, the engaging members 66 are fitted with the engaging recesses 57 of the pallet 50 so as to prevent the stay 62 from moving forward and backward, so that the fixing device 60 is maintained in such article-released position. From the state of FIG. 18, when an operator pushes the pallet 50 backward with his/her finger put on the grip portion 61, the urging member inside the stay 62 is compressed. As a result, the engaging members 66 are pulled into the stay 62 until the front end of each of the engaging members 66 forms a substantially single plane with each side face of the stay 62. Thus, the engagement between the stay 62 and the main body of the pallet 50 is released. Further, as illustrated in FIG. 19, when the stay 62 is moved toward the rear side of the pallet 50, the engaging members 66 are fitted with engaging recesses, not illustrated, provided to the backing plate 51 (as illustrated in FIG. 13), so that the stay 62 is locked in the article-fix position. At that time, as described for FIG. 16, the fitting portions 65 are projected from the upper face of the backing plate 51, thereby allowing the article to be fixed.

According to the second example embodiment, as described above, the mechanism for engaging the stay 62 to the pallet 50 has the engaging members 66 urged by the urging member so as to be movable forward and backward and the engaging recess portions including the engaging recesses 57 provided to the outer peripheral portion 50*a* of the main body of the pallet 50 and the above-described engaging recesses provided to the backing plate 51. Such configuration allows the stay 62 to be fixed to and released from the pallet 50 simply by moving the stay 62 in the sliding direction. It should be noted that such engaging members may be provided to the main body of the pallet 50 while such engaging recess portions may be provided to the stay 62.

Although configurations similar to the configurations of the fitting portions 15 and the attachment locks 112 according to the first example embodiment may be employed for the fitting portions to fit with an article according to the secondary example embodiment, another configuration is described here. As illustrated in FIG. 15, for the fitting portions 65 in the second example embodiment, a cutout portion 65*b* of a substantially semicircular shape at a ceiling face 65*a* and a cutout portion of an arc shape close to the cutout portion 65*b* form an opening portion that is opened toward the rear side of the pallet 50.

Figure 20:
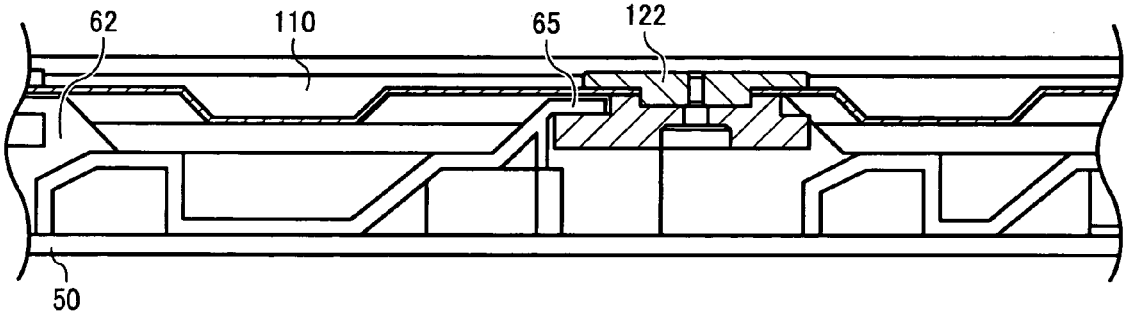
FIG. 20 is a partial sectional view illustrating a fixed state in which an article is fixed on the pallet by the fixing device.
Figure 21:
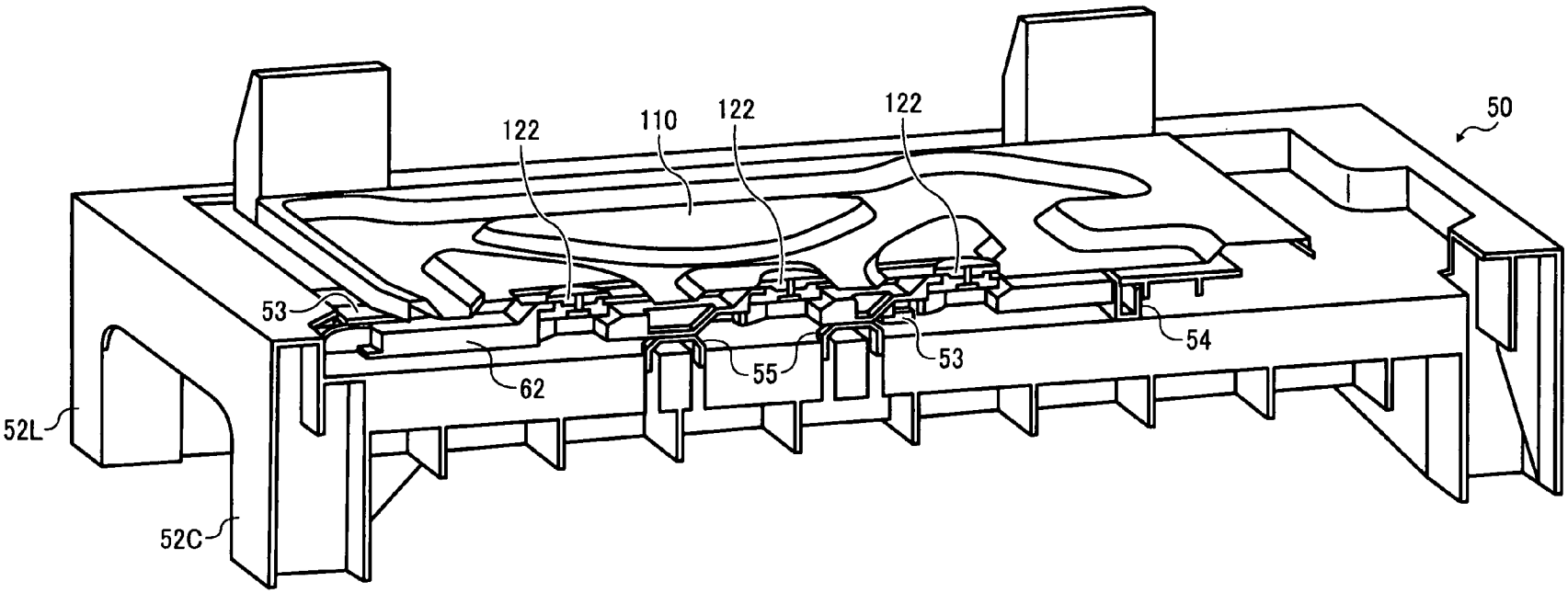
FIG. 21 is a sectional perspective view illustrating the pallet cut along a longitudinal direction of the fixing device.
Figure 22:
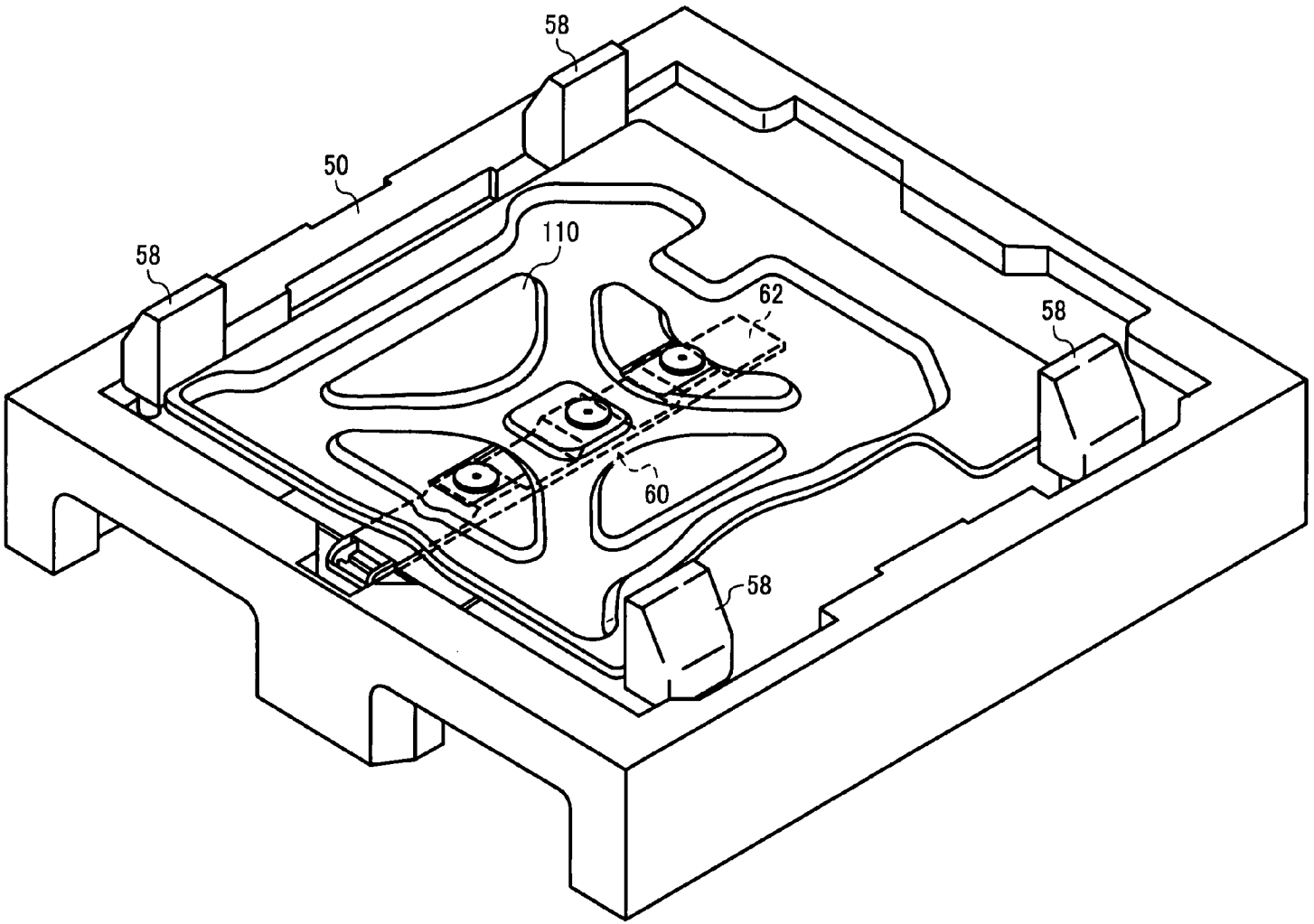

FIG. 20 is a partial sectional view illustrating a fixed state in which an article is fixed on the pallet 50 by the fixing device 60. FIG. 21 is a sectional perspective view illustrating the pallet 50 cut along a longitudinal direction of the fixing device 60. FIG. 22 is a perspective view of the pallet 50 in which the fixing device 60 is seen through.

As illustrated in FIGS. 20 to 22, an article base 110 is attached at a bottom portion of the article, and lock members 122 serving as the fixed member are attached at the article base 110 with screws. According to the second example embodiment, each lock member 122 includes two, upper and lower, cylindrical members, indicated by cross hatching in different directions in FIG. 20. Between the upper and lower members of each lock member 122 is provided a space to which the corresponding fitting portion 65 of the stay 62 is fitted. As described in FIGS. 16 to 19, when the stay 62 is moved toward the rear side of the pallet 50, the stay 62 is run onto the lift members 55 and pushed upward. As a result, the fitting portion 65 is fitted to the space between the upper and lower members of each lock member 122. As illustrated in FIG. 20, the fitting portion 65 and the lock member 122 are arranged at three points in the longitudinal direction of the pallet 50 so that the article is fixed on the pallet 50 by the fixing device 60. In FIG. 22, four article-regulation members 58 attached at the backing plate 51 are illustrated although the backing plate 51 is omitted in FIG. 22.

Similar to the first example embodiment, rubber feet 111 attached at the article are mounted outside an area in which the fixing device 60 is disposed on the upper face of the pallet 50, that is, the backing plate 51 in the secondary example embodiment. Similar to the first example embodiment, the bottom faces of the lock members 122 are substantially leveled to the bottom faces of the rubber feet 111 so as not to project downward therefrom. Accordingly, when an article is put off from the pallet 50 and set to a setting place, an operator can smoothly perform such setting operation. Such configuration allows the lock members 122 as well as the rubber feet 111 to receive shock during transport, thereby allowing such shock to be dispersed.

In the second example embodiment, the fixing device 60 is also provided to the central beam portion of the pallet 50, thereby allowing the fixing device 60 to be disposed on the pallet 50 without reducing the rigidity and/or strength of the pallet 50. It should be noted that the position of the fixing device 60 is not limited to such central beam portion. The fixing device 60 may be disposed at any other suitable portion or along a direction perpendicular to the central beam, for example. It should be noted that the number of fixing devices is not limited to one. For example, two fixing devices may be provided on both left and right sides of the pallet 50 in the width direction, that is, the horizontal direction in FIG. 13. Alternatively, in addition to the above-described fixing device on the central beam portion, such two fixing devices may be provided to the pallet 50.

In unpacking an article, as described for FIGS. 16 and 17, the fixing device 60 is moved forward to release the engagement at the three points between the lock members 122 and the fitting portions of the stay 62, thereby allowing an operator to relatively easily put off the article from the pallet 50. At that time, the fixing device 60 is stored in the main body of the pallet 50 and the stay 62 is not projected from the upper face of the backing plate 51, so that operations such as relocation of the article can be smoothly performed.

Figure 23:
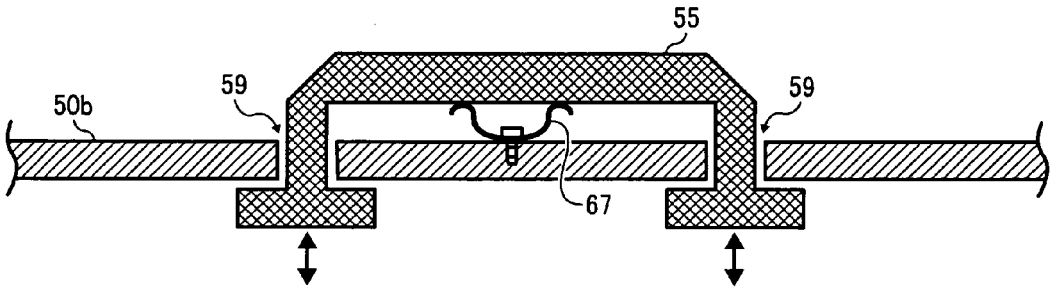
FIG. 23 is a partial sectional view illustrating a lift member and its neighboring area.

FIG. 23 is a partial sectional view illustrating the lift member 55 and its neighboring area.

As illustrated in FIG. 23, the main body of the pallet 50, more specifically, the recessed portion 50*b* has mount holes 59 to mount the lift member 55. Vertical portions of each lift member 55 are fitted to the mount holes 59. Stopper portions are provided at the lower ends of the vertical portions. The lift member 55 is supported so as to be movable at least upward and downward. An elastic member 67 (e.g., leaf spring) is attached and fixed to the upper face of the main body of the pallet 50, more specifically, the recessed portion 50*b* below the lift member. Thus, the elastic member 67 is located between the lift member 55 and the main body of the pallet 50. As a result, in the article-fix state in which the article is fixed to the pallet 50 by the fixing device 60, when an external force due to vibration or shock during transport is applied to the fixing device 60, the elastic member 67 can be bent to absorb such external force, thereby preventing the article and the pallet 50 from being damaged or deformed. It should be noted that the elastic member 67 may be attached to the lift member 55. The elastic member is not limited to a leaf spring but may be any other suitable member such as a coil spring or a foamed member.

Figure 24:
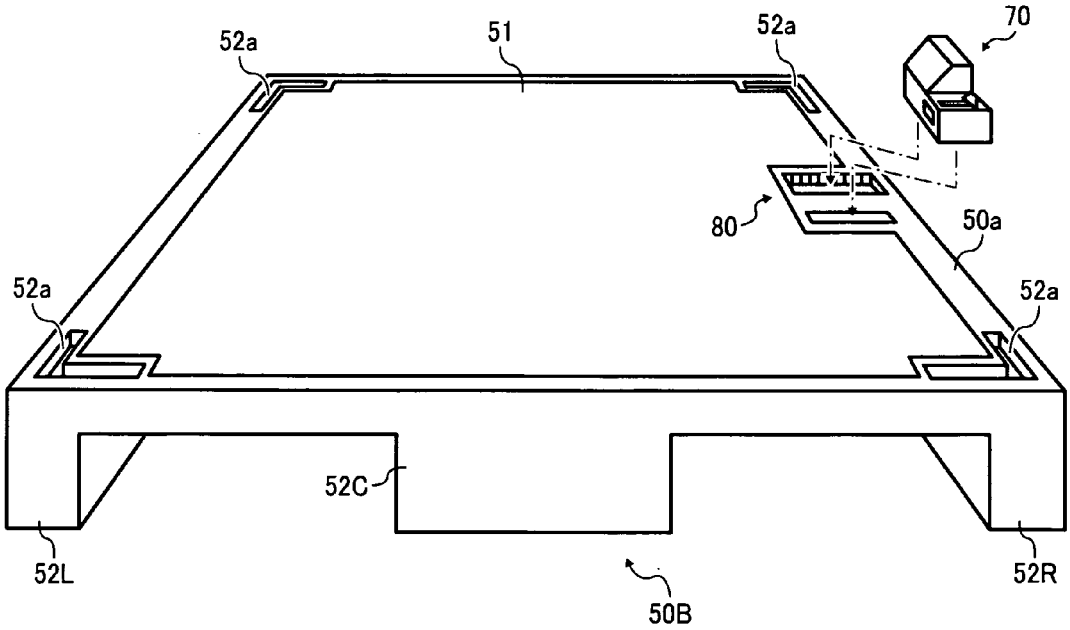
FIG. 24 is a schematic view illustrating a pallet according to a third example embodiment.

FIG. 24 is a schematic view illustrating a pallet 50B according to a third example embodiment.

The pallet 50B of FIG. 24 has a recessed portion inside an outer peripheral portion 50*a* on the upper face of the pallet 50B. A backing plate 51 is fitted to the recessed portion. A fixing-device mount portion 80 for mounting a fixing device 70 is disposed on a right-side portion of the outer peripheral portion 50*a* in FIG. 24 and at a middle portion in a longitudinal direction of the pallet 50B. Although in FIG. 24 the fixing-device mount portion 80 is provided at one point in the longitudinal middle portion of the right side, the fixing-device mount portion 80 may be provided at two points in the longitudinal direction of the right side or at one point in a longitudinal middle portion of the left side. Alternatively, the fixing-device mount portion 80 may be provided at one point in a longitudinal middle portion of each of the left and right sides, or at two points in the longitudinal direction on each of the left and right sides. In such case, the number of the fixing devices 10 attached to the fixing-device mount portions 80 may be identical to the number of the fixing-device mount portions 80. Alternatively, the number of the fixing devices 70 attached to the fixing-device mount portions 80 may be smaller than the number of the fixing-device mount portions 80.

Figure 25A:
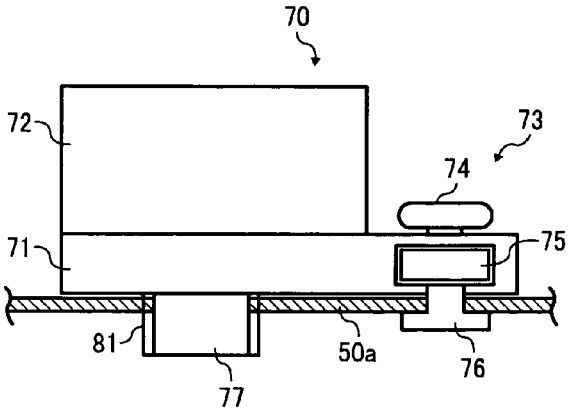
FIG. 25A is a side view illustrating a fixing device and a mount portion for mounting the fixing device according to the third example embodiment.
Figure 25B:
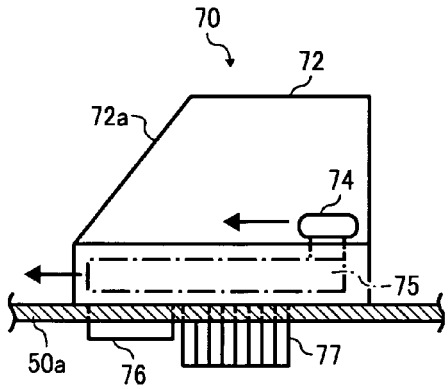
FIG. 25B is a front view illustrating the fixing device and the mount portion of FIG. 25A.
Figure 25C:
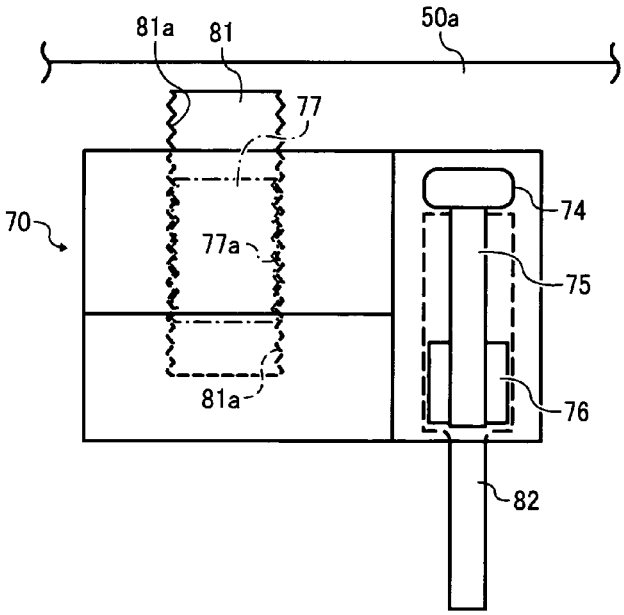
FIG. 25C is a plan view illustrating the fixing device and the mount portion of FIG. 25A.

As illustrated in FIGS. 25A, 25B, and 25C, the fixing device 70 has an article-hold portion 72 on a base 71 and a guide slant 72*a* on its front side. A portion of the upper face of the base 71 is formed as an operation portion 73 in which a lock lever 74 is supported in a slidable manner. At the lower portion of the lock lever 74 is attached a movable member 75 extending substantially parallel to with the upper face of the pallet. A fitting member 76 is disposed under a front end portion of the movable member 75, that is, an end portion of a side opposite the side of the lock lever 74. At least one of the lock lever 74 and the fitting member 76 may be integrally formed with the movable member 75.

As illustrated in FIG. 25A, the movable member 75 and the fitting member 76 form a substantially 90-degree-rotated H-shape. In an upper-face member of the fixing-device mount portion 80 of the outer peripheral portion 50*a* is provided a slit 82 for fitting with a pillar portion of the fitting member 76. That is, the upper-face member of the fixing-device mount portion 80 is fitted with concave portions of the H-shape so that the movable member 75 and the fitting member 76 are supported in a slidable manner. With an operation of the lock lever 74, the movable member 75 and the fitting member 76 are guided to the slit 82 of FIG. 25C so as to project forward, that is, in a direction toward a central portion of the pallet 50B.

A fixing portion 77 is provided so as to project from the bottom face of the fixing device 70. Peripheral wall faces 77*a* are formed in a saw-toothed shape as illustrated in FIG. 25C. Accordingly, internal wall faces 81*a* of a fixing-member fitting portion 81, which are provided to the fixing-device mount portion 80 of the pallet 50B, are also formed in a corresponding saw-toothed shape. With such configuration, when the fixing-member fitting portion 81 is fitted with the fixing portion 77 to mount the fixing device 70 to the fixing-device mount portion 80, the fixing device 70 is securely held so as not to be unintentionally moved. Further, the saw-teeth of the peripheral wall faces 77*a* can be shifted to fit with the saw-teeth of the internal wall faces 81*a* in different positions, thereby allowing the mount position of the fixing device 70 to be adjusted.

Figure 26A:
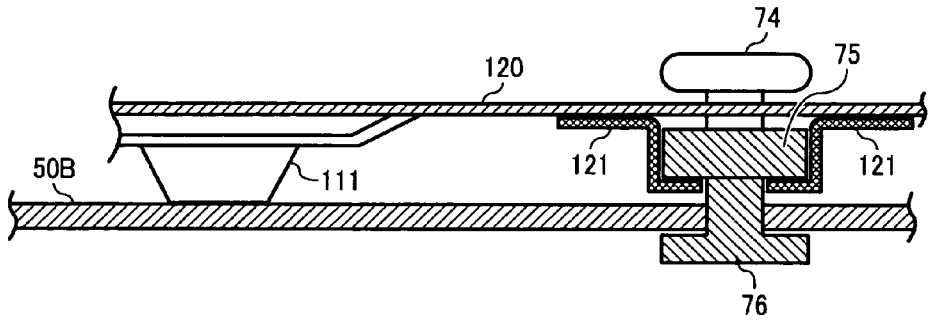
FIGS. 26A and 26B are schematic views for explaining an operation in which an article is fixed by the fixing device according to the third example embodiment.
Figure 26B:
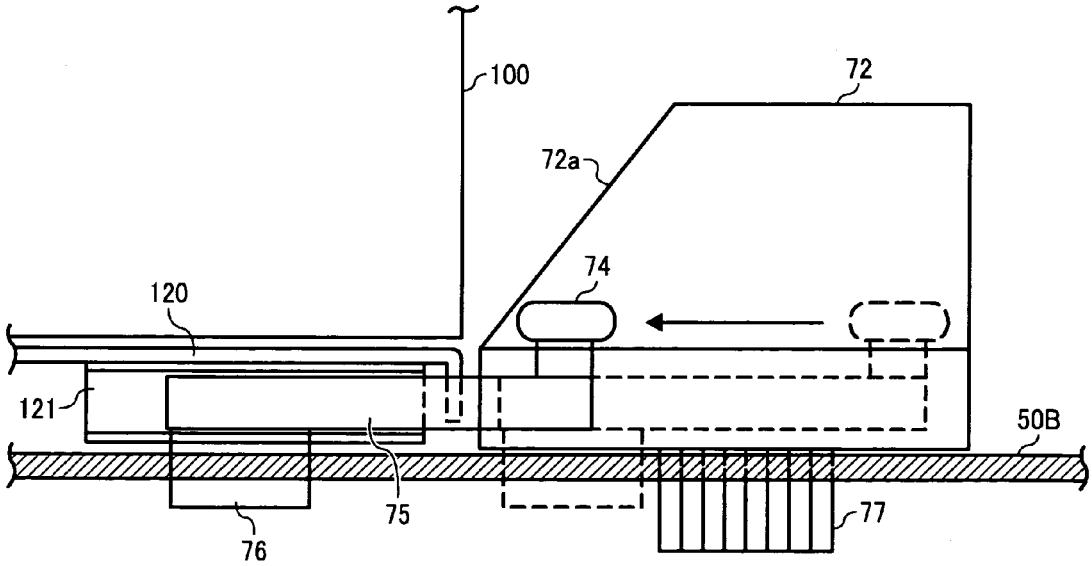

Next, an operation of fixing an article on the pallet 50B by the fixing device 70 is described with reference to FIGS. 26A and 26B. FIG. 26A is a front view of the fixing device 70 viewed from a width direction of the pallet 50B. FIG. 26B illustrates a side view of the fixing device 70 viewed from the front-face side of the pallet 50B.

As illustrated in FIG. 26B, an article base 120 is provided to the bottom face of an article 100, and fixing guides 121 are fixed to the bottom face of the article base 120. In the present example embodiment, as the fixing guides 121, two rail members having a crank shape in cross section are arranged and mounted in parallel with each other to the bottom face of the article base 120. Between the fixing guides 121 is formed a rectangular space, and under a middle portion of the space is formed a slit. The movable member 75 of the fixing device 70 is enterable to the rectangular space. Further, the fitting member 76, more specifically, the pillar portion of the fitting member 76 is enterable to the slit between the fixing guides 121. As illustrated in FIG. 26B, an outer end portion of the article base 120 is bent downward. At such bent portion is provided a cutout portion, not illustrated, into which the movable member 75 and the fitting member 76 are insertable.

For such configuration, as illustrated in FIG. 26B, when the article 100 is mounted at a predetermined position on the mount face of the pallet 50B and the lock lever 74 of the fixing device 70 is operated to move in a direction indicated by the arrow in FIG. 26B, the movable member 75 and the fitting member 76 are slid below the article 100 to fit with the fixing guides 121, which are provided to the bottom face of the article 100. Thus, the article 100 is locked to the pallet 50B by the fixing device 70. In the third example embodiment, the fixing device 70 also has the guide slant 72*a*, thereby allowing the article to be relatively easily mounted at a certain mount position.

As described above, the mount position and the number of the fixing device 70 may be set to any suitable position and number according to need. That is, the mount position and the number of the fixing device 70 for fixing an article on the pallet may be determined according to the article. When the lock lever 74 is returned to the original position, the fixing of the article to the pallet is released. It should be noted that, similar to the pallet according to each of the above-described example embodiments, four supports 3 are mountable to the pallet 50B, side walls 5 are set between the supports 3, and a top 4 is mountable to the upper portions of the supports 3.

As described above, for the packing unit according to the present disclosure, the pallet serving as the mount base of an article has the fixing device 10, 60, or 70 so that the article can be fixed directly onto the pallet, thereby preventing the article from bouncing on the pallet due to vibration during transport or the like. If the article bounces during transport, the article may be damaged when the article bounces down. For example, for an image forming apparatus such as the article 100 of FIG. 1 in which a sheet ejection portion 101 is provided within the apparatus body, a scanner unit is provided above the printer unit in a manner that a space including the sheet ejection portion 110 is provided between the scanner unit and the printer unit. Further, an ADF (auto-document feeder) may be provided on the scanner unit. Consequently, such bounce during transport may deform a housing support portion supporting the scanner unit and/or ADF. Alternatively, when the article bounces down, the position of the article might be shifted to drop off a shock-absorbing member functioning as a member for cushioning and absorbing a shock or vibration between the article and the side plates or supports of the packing unit. Meanwhile, the packing unit according to the present disclosure can securely prevent the article from bouncing, thereby effectively preventing various failures from occurring due to the bouncing of the article during transport and the like.

In the packing unit according to the present disclosure, the article fixing member is engaged with the fixed portion provided at the structural base of an article to fix the bottom portion of the article to the pallet or the mount base. Such configuration can prevent a relatively large load from being applied onto the upper face of the article, unlike a packing unit having a configuration in which the article is covered with a net or tied with a belt. Even when packing an image forming apparatus with an ADF having a relatively complicated shape, the image forming apparatus can be fixed directly on the pallet in a relatively secure and simple manner. Further, the packing unit is capable of dealing with a wide variety of articles with respect to the height of article and the shape or presence/absence of an optional unit such as ADF.

Further, since the packing unit can fix an article onto a pallet, the article can be prevented from interfering with the supports and/or side plates. Accordingly, such cushion members for preventing the article from being damaged due to such contact between the article and the supports and/or side plates can be omitted. As a result, various types of shock-absorbing members need not be prepared in accordance with the shape of article or the presence/absence of an optional unit, which may reduce packing cost.

In the packing unit, the fixing device has the article fixing member such as the stay 12, the stay 62, or the movable member 75. With such configuration, an article or product can be fixed on the pallet in a relatively simply manner only by moving the article fixing member to the article-fix position. Further, such fixation of the article or product can be released only by moving the article fixing member to the release position. Accordingly, the packing unit according to the present disclosure is capable of fixing or releasing an article onto or from a pallet by a relatively simple operation. Thus, a packing unit with a relatively high operability can be provided.

Although example embodiments are described above with reference to the drawings, example embodiments according to the invention are not limited to the above-described example embodiments.

For example, the article fixing member or the stay 62 according to the second example embodiment may be supported in the manner used in the first example embodiment. That is, the article fixing member may be movably supported by fitting with the fixing-member set portion 21 formed in a groove shape at the main body of the pallet. Alternatively, by contrast, the article-fixing member according to the first example embodiment, that is, the stay 12 may be supported in the manner used in the second example embodiment. That is, the article-fixing member according to the first example embodiment may be movably supported by the guide members 53 attached to the recessed portion 50*b* of the main body of the pallet. The lift member for pushing up the article fixing member may be integrally formed with the main body of the pallet as in the first example embodiment or may be attached to the main body of the pallet as in the second example embodiment.

The engaging portion for engaging with the fixed portion of the article side, provided to each article-fixing portion, may have a suitable configuration as needed. Further, any suitable configuration may be employed to engage the article fixing member to the main body of the pallet at the article fixing position.

The packing unit may be formed with a pallet or a mount base only. Alternatively, when the packing unit has supports, side plates, and a top, any suitable shape or structure may be employed for the supports, the side plates, and the top. A product or article to be mounted on the packing unit is not limited to an image forming apparatus but may be any other suitable product or article.

Figure 27:
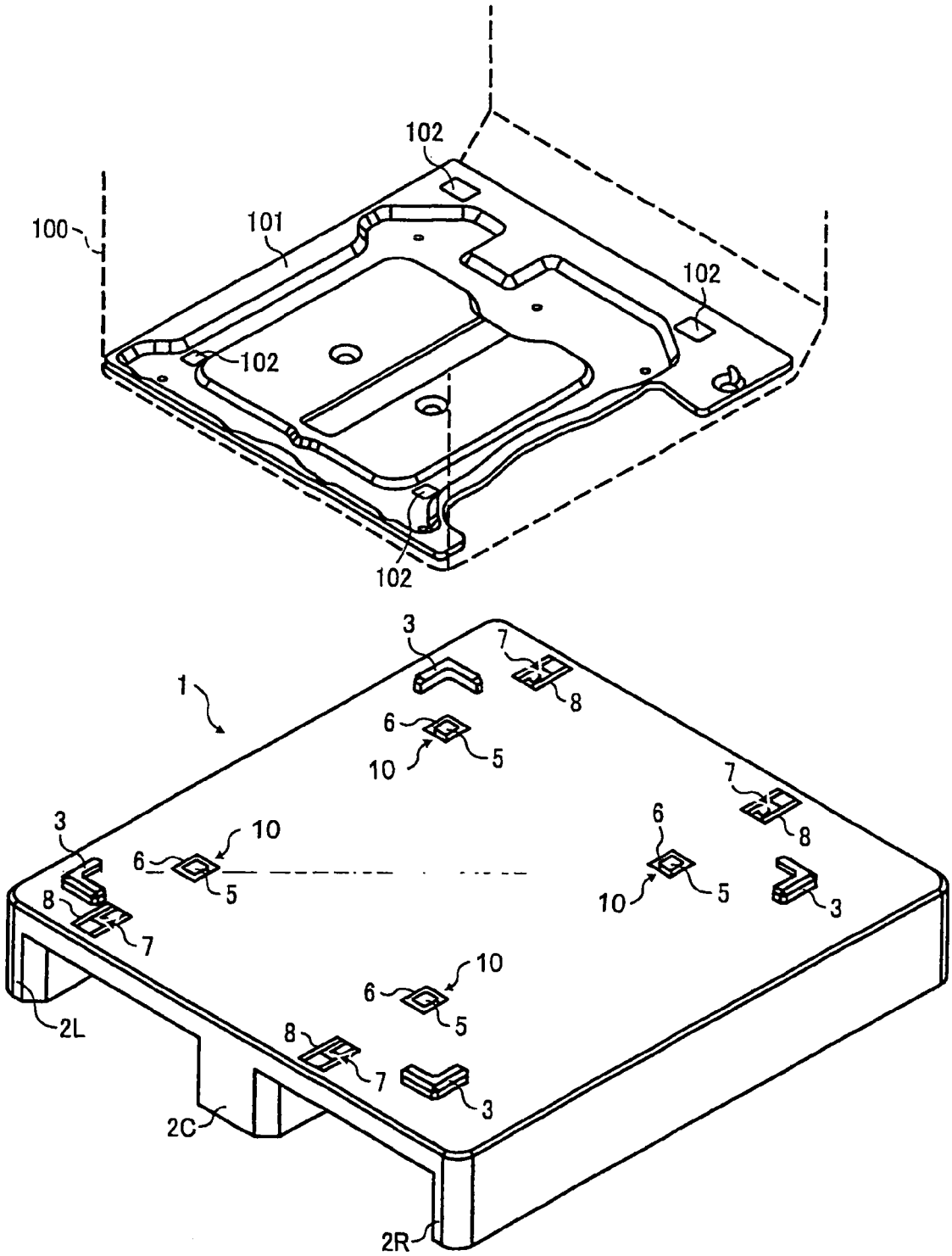
FIG. 27 is a perspective view illustrating a pallet serving as a packing unit according to a fourth example embodiment and a portion of an article.

FIG. 27 is a perspective view illustrating a packing unit according to a fourth example embodiment and a portion of an article.

Figure 28:
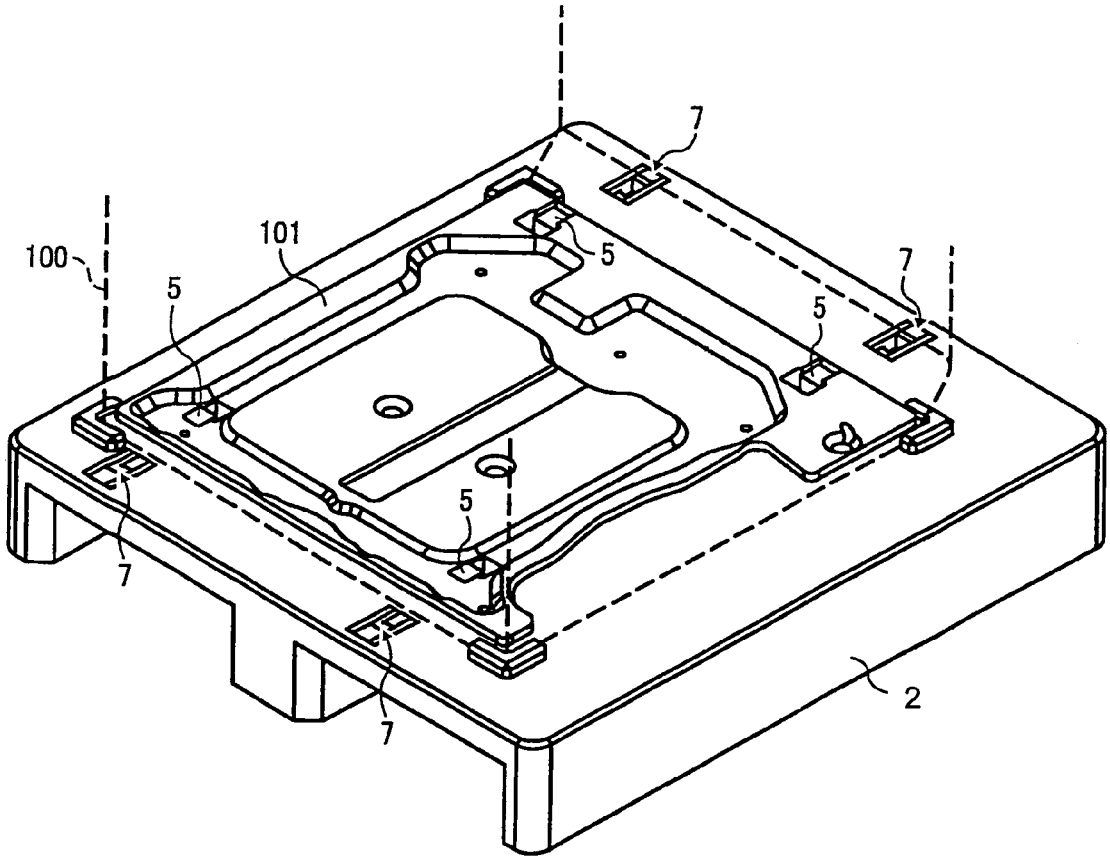
FIG. 28 is a perspective view illustrating a state in which an article is mounted and fixed on the pallet of FIG. 27.

FIG. 28 is a perspective view illustrating a state in which the article is mounted and fixed on the packing unit.

As illustrated in FIGS. 27 and 28, the packing unit 1 according to the fourth example embodiment is configured as a pallet (hereinafter "pallet 2") to mount the article 100 thereon. The pallet 2 has a left beam 2L, a central beam 2C, and a right beam 2R at its left-end, middle, and right-end portions, respectively. Between the three beams 2L, 2C, and 2R are formed insertion openings into which a fork of a forklift is insertable. On an upper face of the pallet 2, positioning members 3 for positioning the article 100 on the pallet are provided so as to project upward from the upper face. In the fourth example embodiment, the four positioning members 3 are disposed on four corners of the article 100 so as to contact four corners of the article 100 with pressure. Preferably, the main body of the pallet 2 and the positioning members 3 include a resin material such as PP (polypropylene) or PE (polyethylene) in view of cost, weight, and so on.

In the fourth example embodiment, the positioning members 3 are integrally formed with the pallet on the upper face of the pallet. It should be noted that the positioning members may be provided independently of the pallet so as to be detachably attached to the pallet. In such case, preferably the positioning members 3 are detachably attached to an article in accordance with the type of the article. For example, a plurality of holes may be formed in the upper face of the pallet so that the positioning members 3 are attachable to any of the holes with screws.

In the main body of the pallet 2 are disposed fixing devices 10 to fix the article 100 onto the pallet 2. Each of the fixing devices 10 has a hook 5 and an operation portion 7. The configuration and operation of the fixing device 10 are later described in further detail.

The hook 5 is projectable from a hole 6, provided in the upper face of the pallet, to an external position (e.g., a fix position at which the article is fixed) and storable within the pallet. The operation portion 7 is operated from a setting portion 8 opened in the upper face of the pallet. The pallet 2 according to the fourth example embodiment has the four fixing devices 10. The hooks 5 of the fixing devices 10 are arranged to form a substantially square shape in an internal area of the positioning members 3. On the bottom of the article 100 is attached an article base 101 made of, for example, sheet metal. The article base 101 has four hook insertion holes 102 into which the hooks 5 of the fixing devices 10 are insertable. As illustrated in FIG. 28, the article base 101 of the article 100 mounted on the pallet 2 is latched onto the upper face of the pallet, so that the article 100 is fixed onto the pallet 2.

Figure 29:
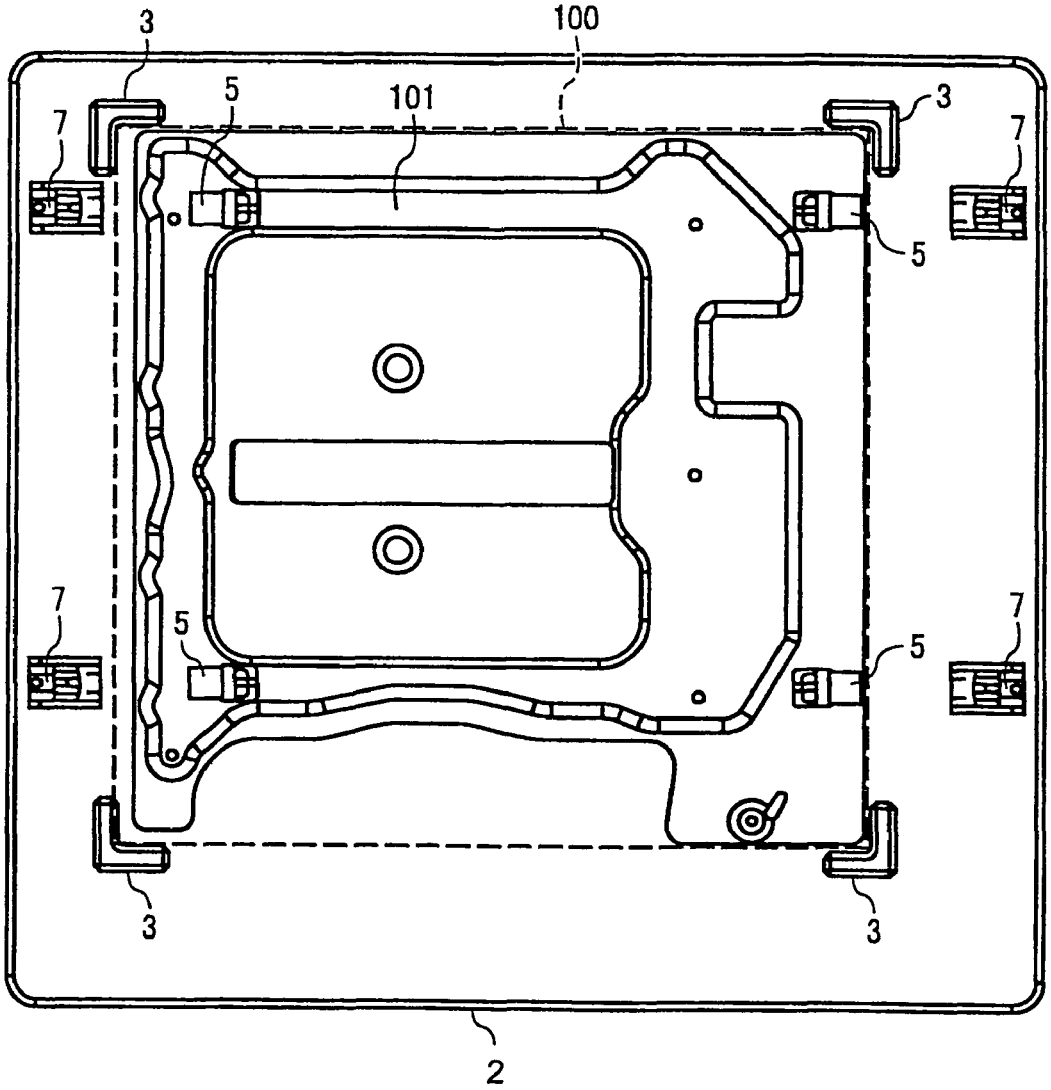
FIG. 29 is a top view illustrating a state in which the article is mounted and fixed on the pallet.

FIG. 29 is a top view illustrating a state in which the article 100 is mounted and fixed on the pallet 2. An outline of the article 100 is represented by a dashed line indicating an outer plate of the article 100, and an outline of the article base 101 is represented by a solid line. As seen in FIG. 29, the positioning members 3 allow the article to be relatively easily positioned when the article 100 is mounted onto the pallet 2, thereby facilitating such packing operation. Further, the positioning members 3 can prevent the article from being moved due to a shock applied from a horizontal direction during transport, thereby reducing a load against the hooks 5 or the fixing devices 10. Further, such configuration can prevent the article and the hooks 5 from contacting each other, thereby facilitating unloading or unpacking operation.

Figure 30:
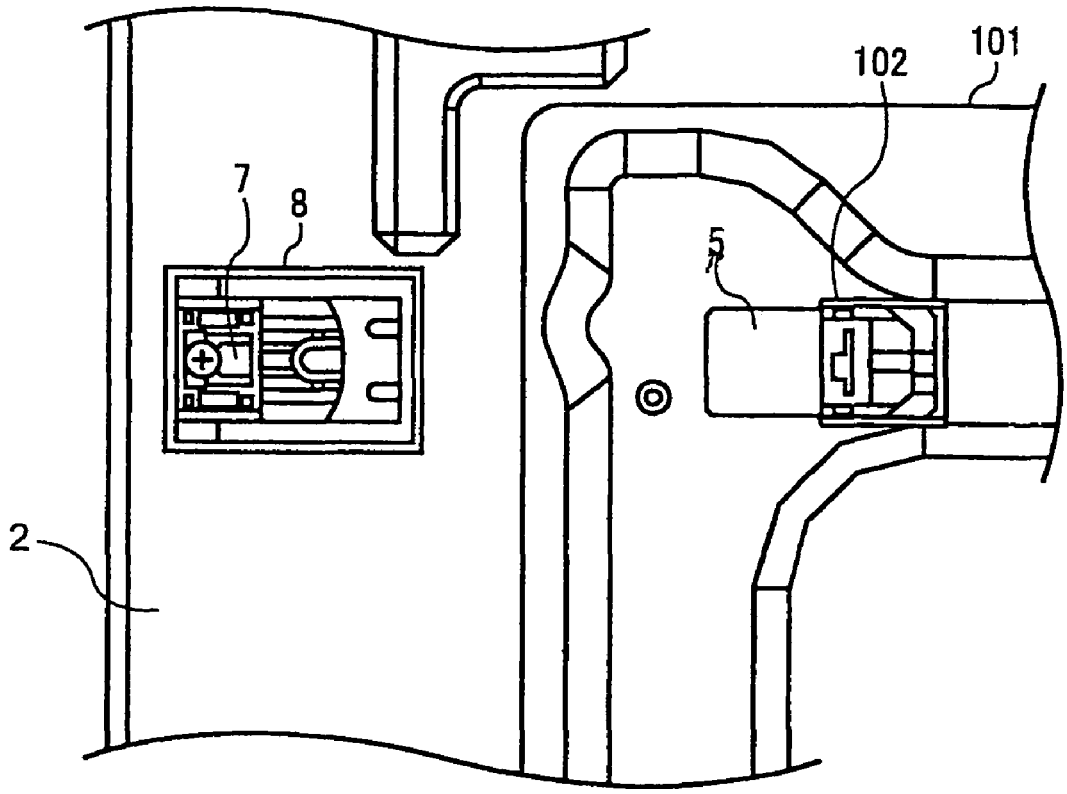
FIG. 30 is an enlarged view illustrating an article fixing portion and its neighboring area.

FIG. 30 is an enlarged view illustrating an article fixing portion and its neighboring area. As illustrated in FIG. 30, the article base 101 or the article 100 is mounted and fixed on the upper face of the pallet 2 by the hook 5, which is inserted from the hook insertion hole 102 formed at the article base 101. The hook 5 is inserted or retreated by operating the operation portion 7.

Figure 31:
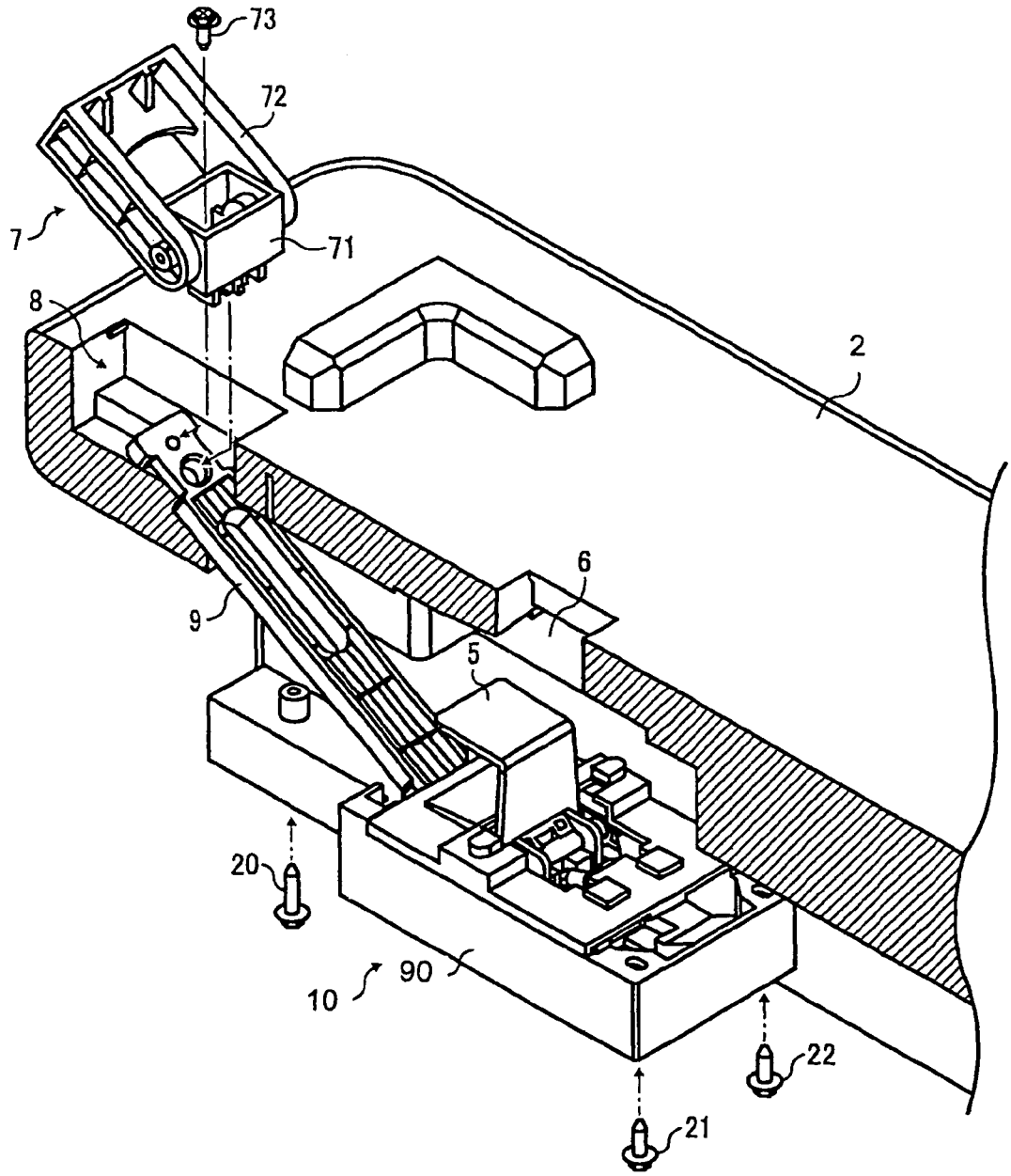
FIG. 31 is a perspective view illustrating a fixing device disposed within the pallet, in which a portion of the pallet is partially cut out.

FIG. 31 is a perspective view illustrating the fixing device 10 disposed within the pallet 2, in which a portion of the pallet 2 is partially cut out.

Figure 32:
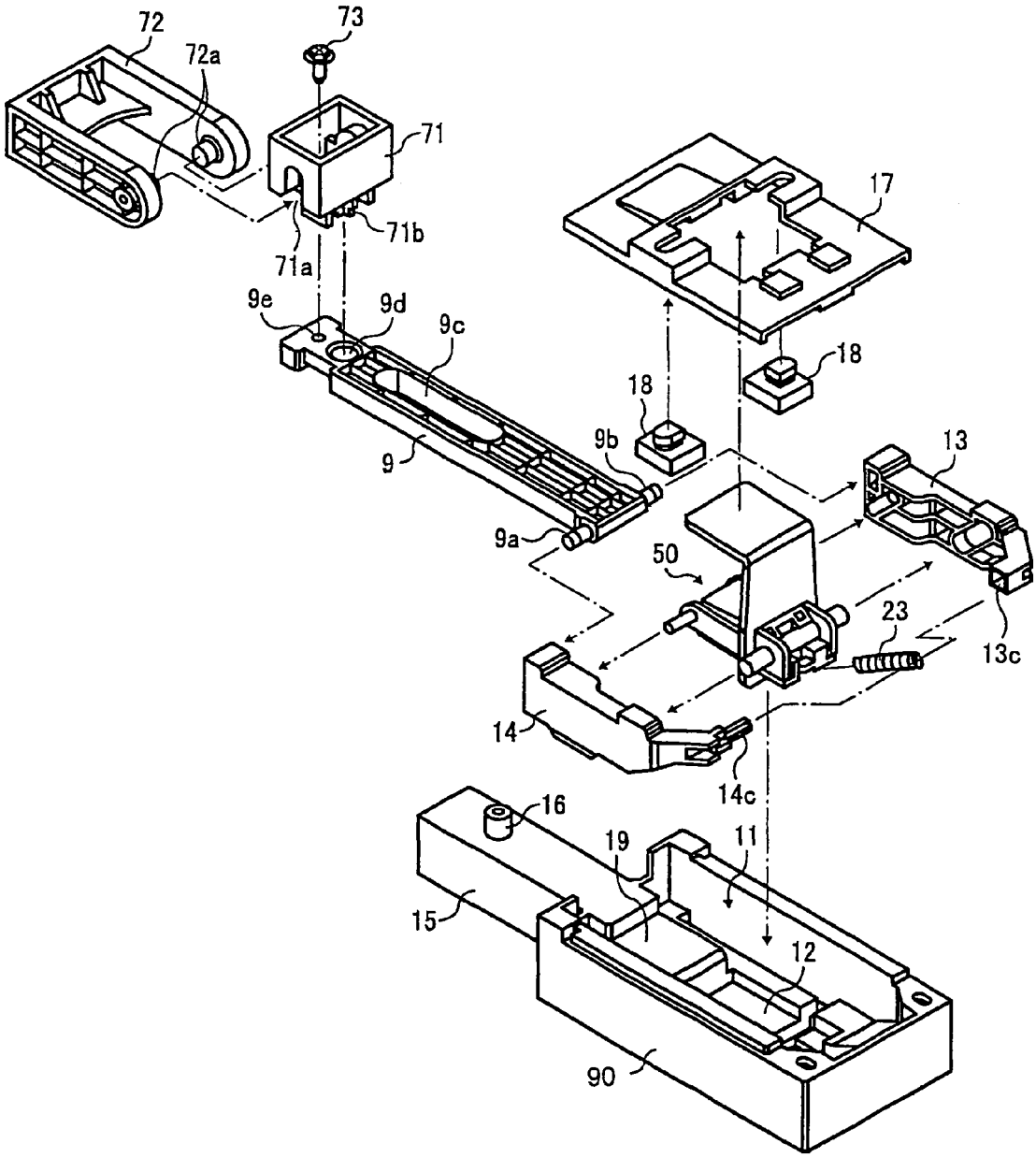
FIG. 32 is an exploded perspective view of the fixing device.

FIG. 32 is an exploded perspective view of the fixing device 10.

Figure 33:
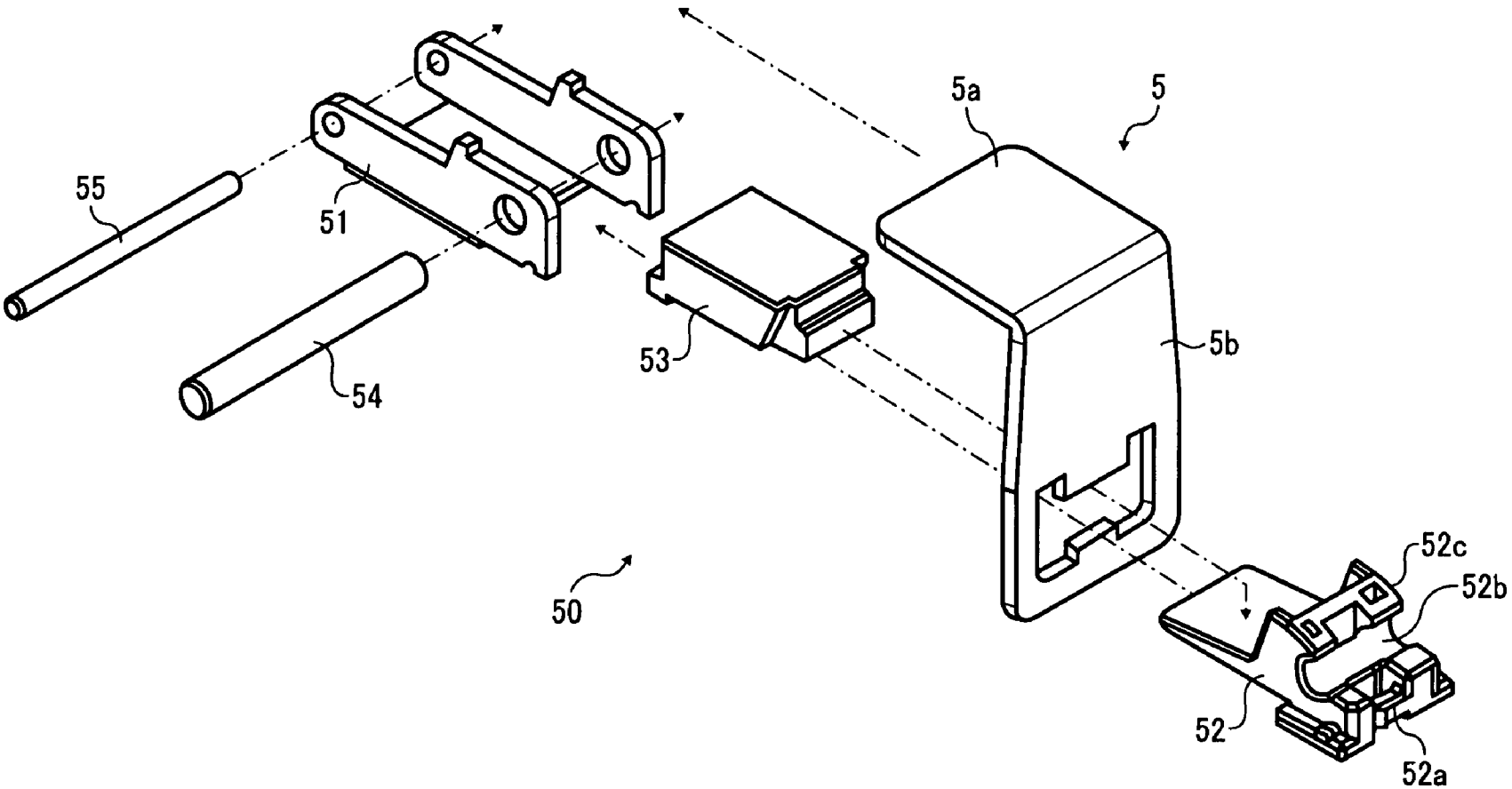
FIG. 33 is an exploded perspective view illustrating a hook assembly of the fixing device.

FIG. 33 is an exploded perspective view illustrating a hook assembly 50 of the fixing device 10.

Figure 34:
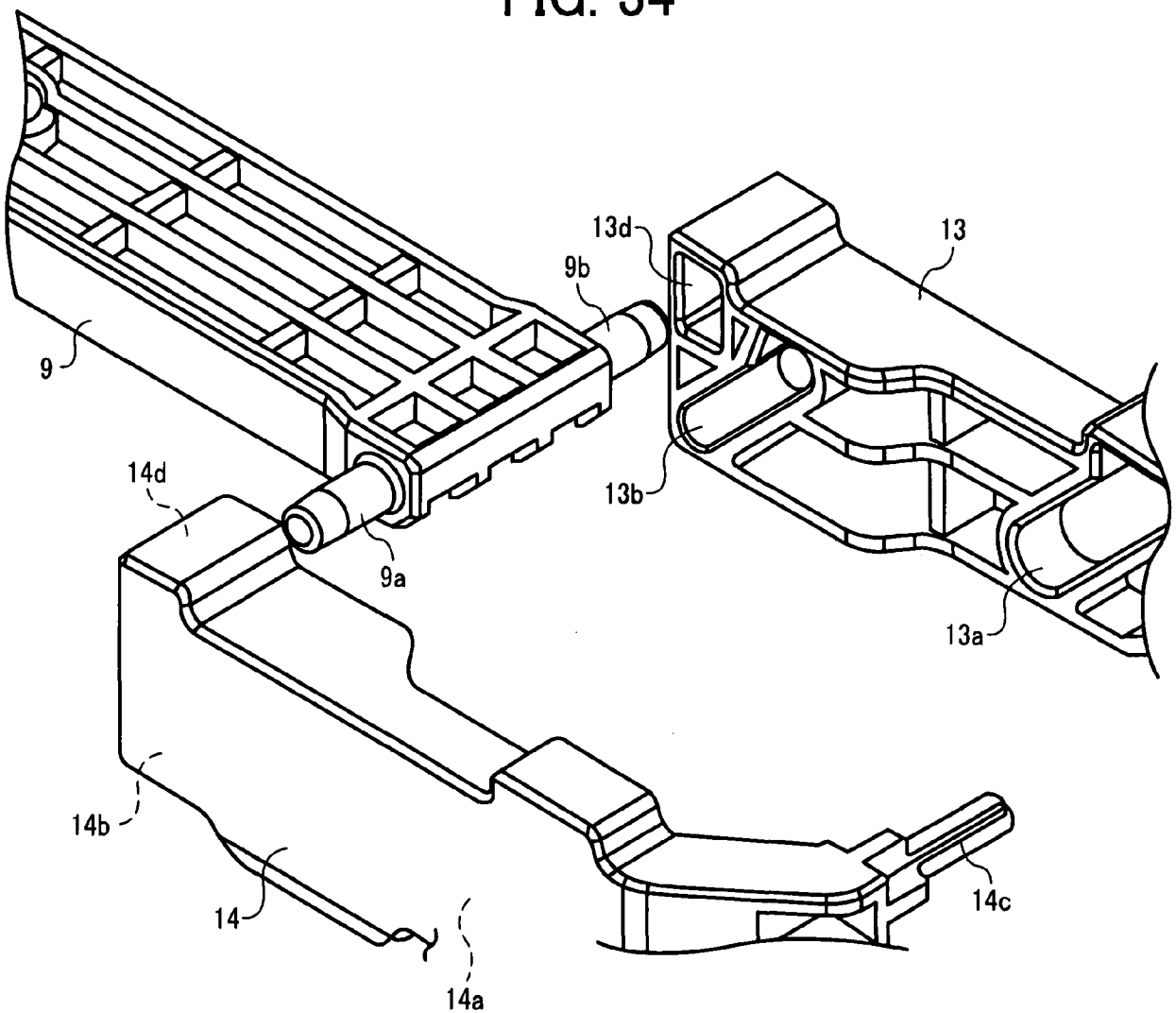
FIG. 34 is an enlarged view illustrating a guide member for guiding the hook assembly.

FIG. 34 is an enlarged view illustrating guide members 13 and 14 for guiding the hook assembly 50.

A description is given below of the fixing device 10 with reference to FIGS. 31 to 34.

As illustrated in FIGS. 31 to 34, each fixing device 10 has a hook assembly 50 including the hook 5 and a moving mechanism including a holder 90 for holding the hook assembly 50, the operation portion 7, and a connector 9 for connecting the holder 90 to the operation portion 7. FIG. 31 illustrates a state in which the operation portion 7 is detached from the connector 9.

As illustrated in FIG. 33, the hook assembly 50 has the hook 5, a hook fix plate 51, a shaft fix member 52, a buffer member 53, a larger shaft 54, and a smaller shaft 55. The hook fix plate 51 and the shaft fix member 52 are inserted into a cutout hole formed at the hook 5, and the buffer member 53 is inserted into the cutout hole of the hook 5 so as to be positioned between two side-plate portions of the hook fix plate 51. When the larger and smaller shafts 54 and 55 are inserted into bearing holes formed at the hook fix plate 51, the hook assembly 50 is assembled in a shape illustrated in FIG. 32. It should be noted that the larger shaft 54 is inserted into a shaft bearing portion 52*b* formed at the shaft fix member 52. Preferably, each of the hook 5, the hook fix plate 51, the larger shaft 54, and the smaller shaft 55 is made of a metal having a relatively large strength, more preferably a stainless steel having relatively high rust resistance and strength. Preferably, the buffer member 53 is made of an elastic member, such as an EPDM rubber, having a relatively high resistance to weather and/or permanent deformation. Preferably, other members except screws are made of a material, such as POM (polyoxymethylene), having a relatively high slidability.

As illustrated in FIG. 32, the hook assembly 50 is held by a hold portion 11 of the holder 90 with the hook assembly 50 sandwiched by a pair of guide members 13 and 14. By sliding the outer faces of the guide members 13 and 14 along the side walls of the hold portion 11, the hook assembly 50 sandwiched by the guide members 13 and 14 can be slid in a longitudinal direction of the holder 90 inside the hold portion 11.

As illustrated in FIGS. 32 and 34, the guide members 13 and 14 have inclined grooves 13*a*, 13*b*, 14*a*, and 14*b* into which the larger and smaller shafts 54 are inserted, although in FIGS. 32 and 34 only the inclined grooves of the guide members 13 are visible. By inserting the larger and smaller shafts 54 and 55 into the inclined grooves 13*a*, 13*b*, 14*a*, and 14*b*, the hook assembly 50 is sandwiched by the guide members 13 and 14, thereby allowing the hook assembly 50 to move obliquely upward and downward. Corresponding to such configuration, a retreat portion 12 is formed in the hold portion 11 of the holder 90 so that the hook assembly 50 can be moved down toward the retreat portion 12.

The guide member 14 has a connecting projection 14*c* while the guide member 13 has a fitting hole 13*c* to which the connecting projection 14*c* is fitted. When the guide members 13 and 14 sandwich the hook assembly 50, the connecting projection 14*c* is fitted into the fitting hole 13*c*, so that the guide members 13 and 14 are connected each other. Then a pull spring 23 is latched between the connecting projection 14*c* and a latch portion 52*a* of FIG. 33 provided at the shaft fix member 52 of the hook assembly 50. The pull spring 23 urges the hook assembly 50 obliquely upward, that is, toward the rear side of the pallet 2.

As illustrated in FIGS. 32 and 34, on a rear end portion (on the side of the hook 5) of the connector 9, pivot shafts 9*a* and 9*b* are projected so as to be inserted into shaft fitting portions 13*d* and 14*d* formed at the guide members 13 and 14. Thus, the connector 9 is pivotably held by the holder 90 via the guide members 13 and 14. In FIG. 32, a connector receive portion 15 is provided so as to project from a longitudinal front side of the holder 90. On an upper face of the connector receive portion 15 is projectingly provided a screw guide 16 having, for example, a cylindrical shape. The connector 9 has a slit 9*c* of, for example, an elongate shape. When the connector 9 is rotated to the upper face of the connector receive portion 15 of the holder 90, the screw guide 16 is inserted into the slit 9*c* of the connector 9.

As described above, the guide members 13 and 14, holding the hook assembly 50 and the connector 9 by sandwiching them from both sides, are fitted with the hold portion 11 of the holder 90 and covered by a cover member 17 from above. Pad members 18 are attached to the cover member 17 so as to be located between the cover member 17 and the holder 90. The holder 90 is fixed under an article mount face of the pallet 1 with screws 20 to 22. When the holder 90 is fixed to the main body of the pallet 2 with the screws, the connector 9 is held substantially horizontally with respect to the upper face of the connector receive portion 15 of the holder 90.

Thus, the hook assembly 50, held in the holder 90 via the guide members 13 and 14, is held slidable within the hold portion 11 in the longitudinal direction of the holder 90 and movable obliquely upward and downward.

The operation portion 7 has an operation lever 71 and a lock member 72. The lock member 72 includes tww side-plate portions and pivot shafts 72*a*. The pivot shafts 72*a* are projected toward opposing faces of the side-plate portions. The operation lever 71 has receiving portions 71*a* for receiving the pivot shafts 72*a* although one of the receiving portions 71*a* is visible in FIG. 32. The operation lever 71 has a projection 71*b* fitted to a fitting hole 9*d* formed at a front end portion of the connector 9. The projection 71*b* is fitted to the fitting hole 9*d* of the connector 9. When the operation lever 71 is fixed to the connector 9 by screwing a screw 73 to a screw hole 9*e*, the operation portion 7 is attached to the front end portion of the connector 9. In such state, the lock member 72 is pivotable relative to the operation lever 71 and the connector 9. As illustrated in FIG. 31, the operation portion 7 is attached to the front end portion of the connector 9 with the front end portion of the connector 9 inserted to the setting portion 8. As described later, the lock member 72 is raisable from (see FIG. 36) and insertable into (see FIGS. 35 and 37) the setting portion 8.

Figure 35:
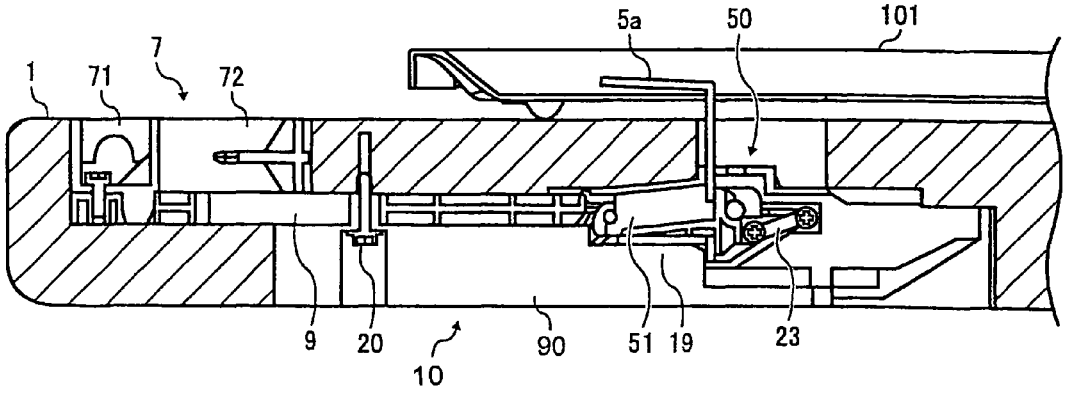
FIG. 35 is a sectional side view illustrating the fixing device of the pallet at an article-fix state.
Figure 36:
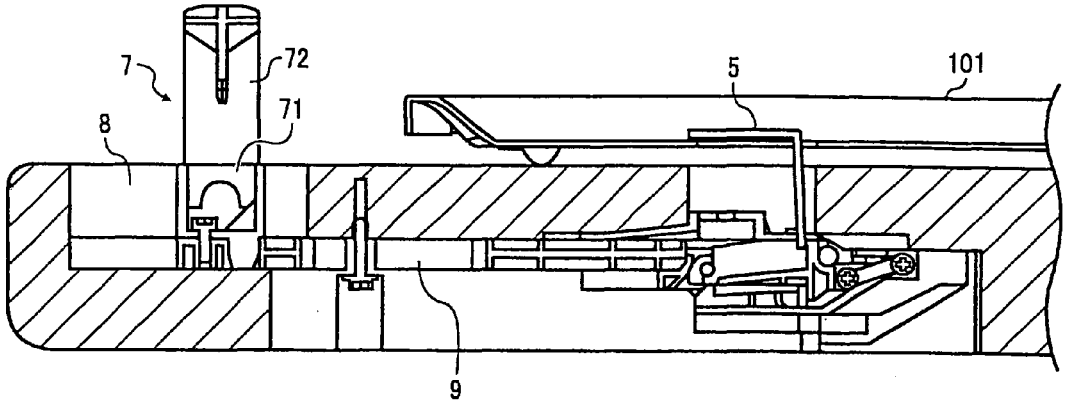
FIG. 36 is a sectional side view illustrating the fixing device of the pallet at an intermediate state.
Figure 37:
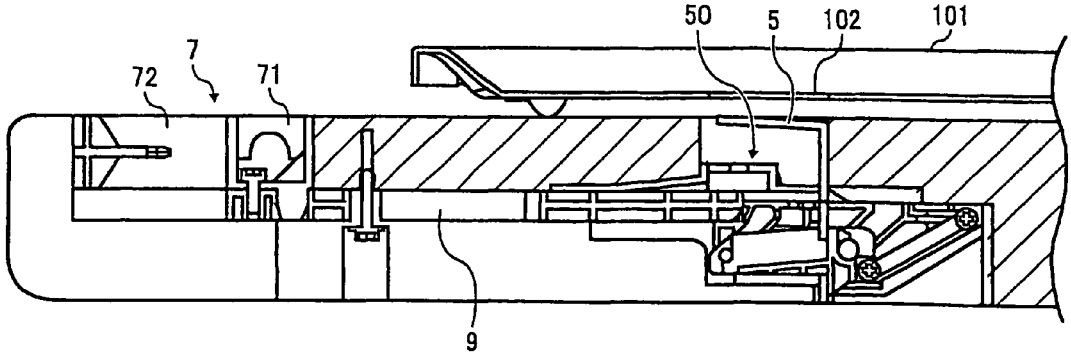
FIG. 37 is a sectional side view illustrating the fixing device of the pallet at a hook-storage state.

Next, an operation of the fixing device 10 is described with reference to FIGS. 35 to 37. FIGS. 35 to 37 are sectional views illustrating the fixing device of the pallet 1 at an article-fix state, an intermediate state, at a hook-storage state, respectively.

In the article-fix state in which the article is fixed to the pallet 2 as illustrated in FIG. 35, the hook assembly 50 sandwiched by the guide members 13 and 14 is moved onto a front end side in the longitudinal direction of the hold portion 11 to be located above a push-up portion 19 (see also FIG. 32) while an article fixing portion 5*a* of the hook 5 is projected outward from the upper face of the pallet 2. In such state, in the operation portion 7, the lock member 72 is rotated toward the rear side of the pallet 1 to be inserted into the setting portion 8 of FIG. 31 or 36. Thus, movements of the connector 9 and the hook assembly 50 can be regulated, thereby forming a lock state. In such lock state, the hook 5 is prevented from moving in either of the longitudinal direction of the holder 90 and the vertical direction.

As illustrated in FIG. 36, when the lock member 72 is rotated to raise from the setting portion 8, such lock state is released and converted into the intermediate state. In such intermediate state, the connector 9 and the hook assembly 50 are movable. By pushing the operation lever 71 toward the rear side of the pallet 2, that is, the right side of FIG. 36, the connector 9 and the hook assembly 50 are movable parallel to the upper face or the article mount face of the pallet 2. Alternatively, by pulling the operation lever 71 toward the front side of the pallet 1, that is, the left side of FIG. 36, the connector 9 and the hook assembly 50 are also movable parallel to the upper face or the article mount face of the pallet 2.

As illustrated in FIG. 37, in the hook-storage state, the hook assembly 50 is elevated down in the retreat portion 12 of FIG. 32 so that the upper face of the hook 5 is substantially leveled to the upper face of the pallet 2.

Thus, the state in which the hook 5 is stored in the pallet 2 is formed. Further, in such hook-storage state, when the lock member 72 is rotated to the front side of the pallet 2, that is, the left side of FIG. 37, the lock member 72 is stored into the setting portion 8. As a result, the connector 9 and the hook assembly 50 are prevented from moving, thereby forming the lock state.

An oblique movement of the hook assembly 50 or the elevating operation of the hook 5 is described later in detail with reference to other drawings. Next, a description is given of operations for fixing the article 100 to the pallet 2 and releasing the fixation of the pallet 2.

As illustrated in FIG. 37, in such hook-storage state, the article 100 is mounted at a predetermined position on the pallet 2. In such case, as illustrated in FIG. 29, by mounting the article 100 onto the pallet 2 while positioning the article 100 with the positioning members 3, the article 100 is mountable onto the pallet 2 so that each hook insertion hole 102 formed at the article base 101 is positioned on the corresponding hook 5 stored in the pallet 2. In FIGS. 35 to 37, the main body of the article 100 is not illustrated and only the article base 101 is illustrated.

When the article 100 is mounted at the predetermined position on the pallet 2 as illustrated in FIG. 37, the lock member 72 is raised to release the lock state illustrated in FIG. 36. When the operation lever 71 is pulled toward the front side of the pallet 2, the hook assembly 50 is pulled by the pull spring 23 to move upward along the inclined grooves 13*a*, 13*b*, 14*a*, and 14*b* of the guide members 13 and 14. As a result, the upper end of the hook 5 projects from the upper face of the pallet 2, and the article fixing portion 5*a* of the hook 5 is moved into the article 100 from the hook insertion hole 102 of the article base 101 as illustrated in FIG. 36. Then, by pulling the operation lever 71 to the front end portion of the setting portion 8, the connector 9 and the hook assembly 50 are moved to a movable limit in the front end portion of the pallet 1 in parallel with the upper face or the article mount face of the pallet 2 (in the present example embodiment, in the horizontal direction). At that time, the article fixing portion 5*a* of the hook 5 is positioned on the article base 101 as illustrated in FIG. 35. When the operation lever 71 is rotated to recline toward the rear side of the pallet 2, the operation lever 71 is fitted into the setting portion 8, thereby forming the lock state. Further, when the article base 101 is pressed against the pallet 2 by the article fixing portion 5*a* of the hook 5, the article 100 is fixed to the pallet 2.

As described above for FIGS. 27 to 29, the pallet 2 according to the fourth example embodiment has other three fixing devices 10 having the same configuration as that of the above-described fixing device 10. By operating the other three fixing devices 10 in a similar manner, the article 100 can be fixed to the pallet 2. The operations of the other three fixing devices 10 are the same as the operation of the above-described fixing device 10 except that the orientations of horizontally movements are opposite between the fixing devices 10 on the rear side of the pallet 2 and the fixing devices 10 on the front side of the pallet 2 because the rear-side fixing devices 10 are set in an orientation opposite to an operation of the front-side fixing devices 10.

When releasing the fixation of the article 100, the above-described operations are performed in a sequence opposite to the above-described sequence. As a result, the hook 5 holding the article base 101 as illustrated in FIG. 35 is moved to the position of the hook insertion hole 102 of the article base 101 as illustrated in FIG. 36. When the hook 5 is moved down to be stored into the pallet 2 as illustrated in FIG. 37, the fixation of the article 100 is released.

Next, the elevating operation of the hook assembly 50 is described with reference to FIGS. 38 and 39. FIGS. 35 to 37 and FIGS. 40 to 43 are also referred as needed.

Figure 38:
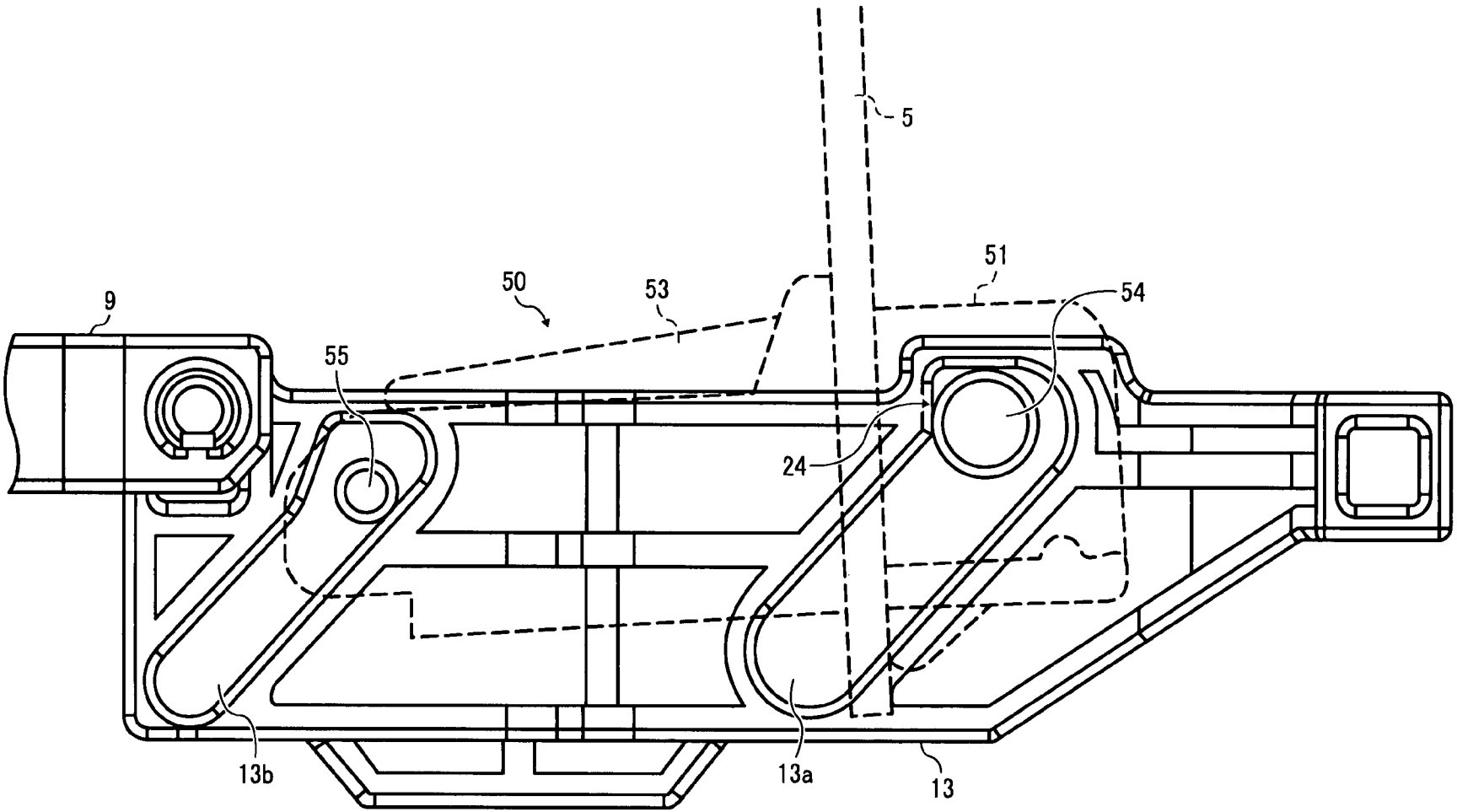
FIG. 38 is an enlarged view illustrating details of the guide member holding the hook assembly.

FIG. 38 is an enlarged view illustrating the guide member 13 for holding the hook assembly 50 in detail. It should be noted that the guide member 14 has a similar but dissymmetrical configuration. As described above, the larger and smaller shafts 54 and 55 of the hook assembly 50 are inserted into the inclined grooves 13*a* and 13*b* (and 14*a* and 14*b*). When the fixing device 10 is positioned at the article-fix state of FIG. 35, the hook assembly 50 is pulled up against the upper end portions of the inclined grooves by an urging force of the pull spring 23. As illustrated in FIG. 36, when the lock member 72 is raised to push the operation lever 71 toward the rear side of the pallet 2, the hook assembly 50 is pulled up to the upper end portions of the inclined grooves. Accordingly, when the connector 9 pushes the guide members 13 and 14 toward the rear side of the pallet 2, as illustrated in FIG. 38 a vertical portion 24 serving as a pressing member formed at the front side (the side of the operation portion 7) of the upper end portion of the inclined groove 13*a* (or 14*a*) abuts the larger shaft 54 to move the hook assembly 50 in a substantially horizontal direction toward the interior of the pallet.

Figure 40:
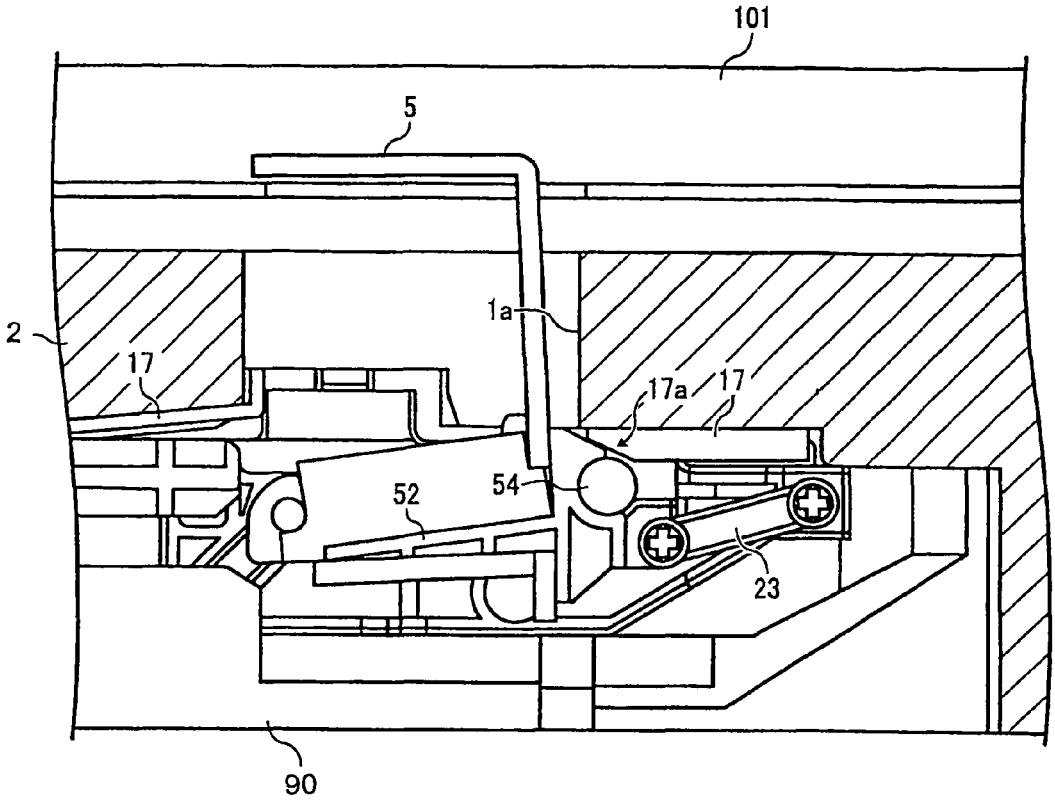
FIG. 40 is an enlarged sectional view illustrating the hook assembly at the intermediate state.
Figure 41:
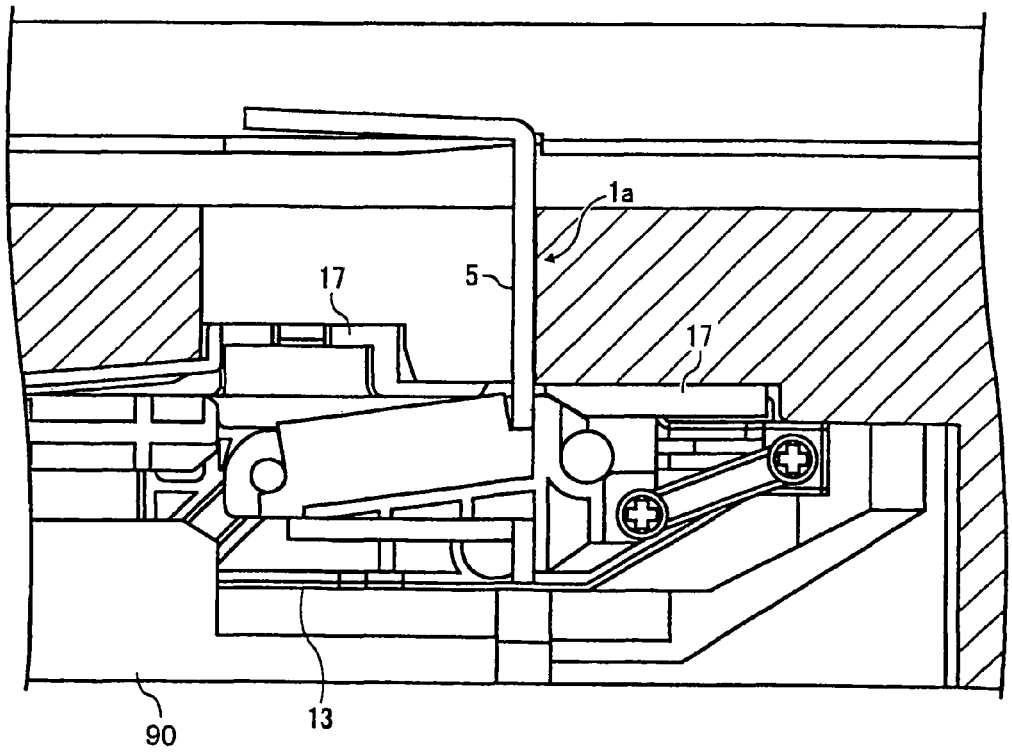
FIG. 41 is an enlarged sectional view illustrating the hook assembly when it starts moving down.
Figure 42:
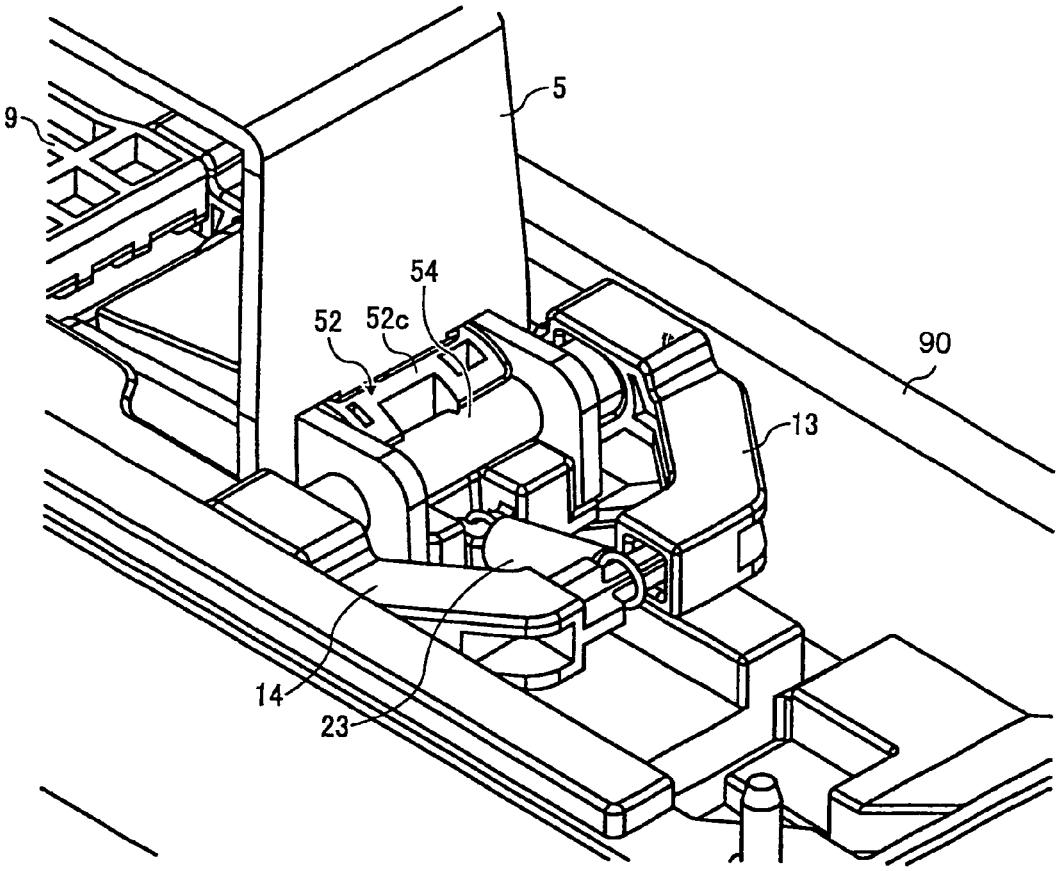
FIG. 42 is a perspective view illustrating a rear portion of the hook assembly.
Figure 43:
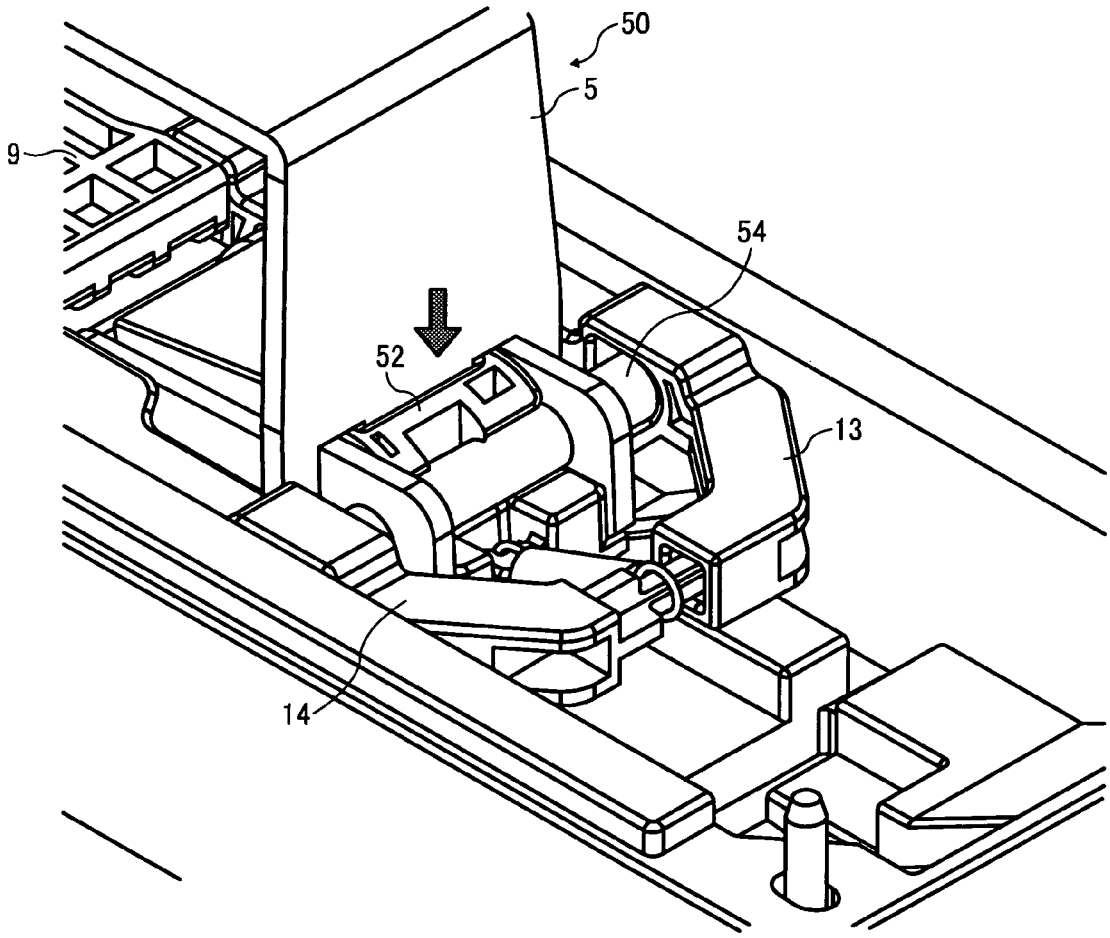
FIG. 43 is a perspective view illustrating a downward movement of the hook assembly.

As illustrated in FIGS. 42, 43, and 33, a slant portion 52*c* is formed at the upper end portion of the shaft fix member 52 forming a part of the hook assembly 50 so as to descend toward the interior side of the pallet 1, that is, the side opposite the side of the operation portion 7. Further, as illustrated in FIG. 40, a slant portion 17*a* is formed on the cover member 17 so as to descend toward the interior side of the pallet 2. During shift to the hook-storage state, when the hook assembly 50 is horizontally moved toward the rear side of the holder 90, the slant portion 52*c* of the shaft fix member 52 starts to contact the slant portion 17*a* of the cover member 17 just before such horizontal movement is finished. When the hook assembly 50 is further moved, the shaft fix member 52 is pushed downward due to an inclination of a contact face between the slant portions 52*c* and 17*a* (FIGS. 40 and 41). When the shaft fix member 52 is pushed downward, the shaft 54 inserted to the shaft bearing portion 52*b* is also pushed downward. As a result, as illustrated in FIG. 39, the shaft 54 is detached from the vertical portion 24 provided at the front side of the upper end portion of the inclined groove 13*a* (14*a*) of the guide member 13 (14). When the shaft 54 is detached from the vertical portion 24 of the inclined groove 13*a* (14*a*), as indicated by bold arrows in FIG. 39, the guide member 13 (14) is pushed in a substantially horizontal direction toward the rear end portion of the holder 90 via the connector 9, so that the shaft 54 is moved down along the inclined groove 13*a* (14*a*). Thus, the hook assembly 50 is moved down into the retreat portion 12 of FIG. 32, and the hook 5 is stored into the pallet 2. In this regard, when the hook assembly 50 is moved down, the pull spring 23 latched between the shaft fix member 52 and the guide members 13 and 14 is pulled and extended.

Thus, when the operation portion 7 is operated so that the operation lever 71 is pushed toward the interior of the pallet 1, the article-fix state of FIG. 35 is shifted to the hook-storage state of FIG. 37 via the intermediate state of FIG. 36. In the present example embodiment, just before the horizontal movement of the hook assembly 50 is finished, the shaft 54 is detached from the vertical portion 24 and is moved down along the inclined groove 13*a* (14*a*). Thus, the hook assembly 50 is relatively smoothly moved downward, that is, the horizontal movement is smoothly converted to the downward movement.

When fixing the article, the upward movement of the hook assembly 50 is conducted in a sequence opposite to the above-described sequence. More specifically, when the operation portion 7 is operated to release the lock and pull the operation lever 71 toward the exterior of the pallet 2, the hook 5 moves up from the position of the hook-storage state of FIG. 37, goes through the intermediate state of FIG. 36, and moves into the article. Then, as illustrated in FIG. 35, the article base 101 is fixed by the hook 5, so that the article is fixed onto the pallet 2.

During a shift from the hook-storage state to the intermediate state, such lock state is released and the operation lever 71 is pulled toward the front side or the exterior of the pallet 2. As a result, the shaft 54 is pulled up through the inclined groove 13*a* (14*a*) by a pulling force of the pull spring 23 of FIG. 32 and a pulling force of the operation lever 71, thereby moving the hook 5 upward.

Figure 39:
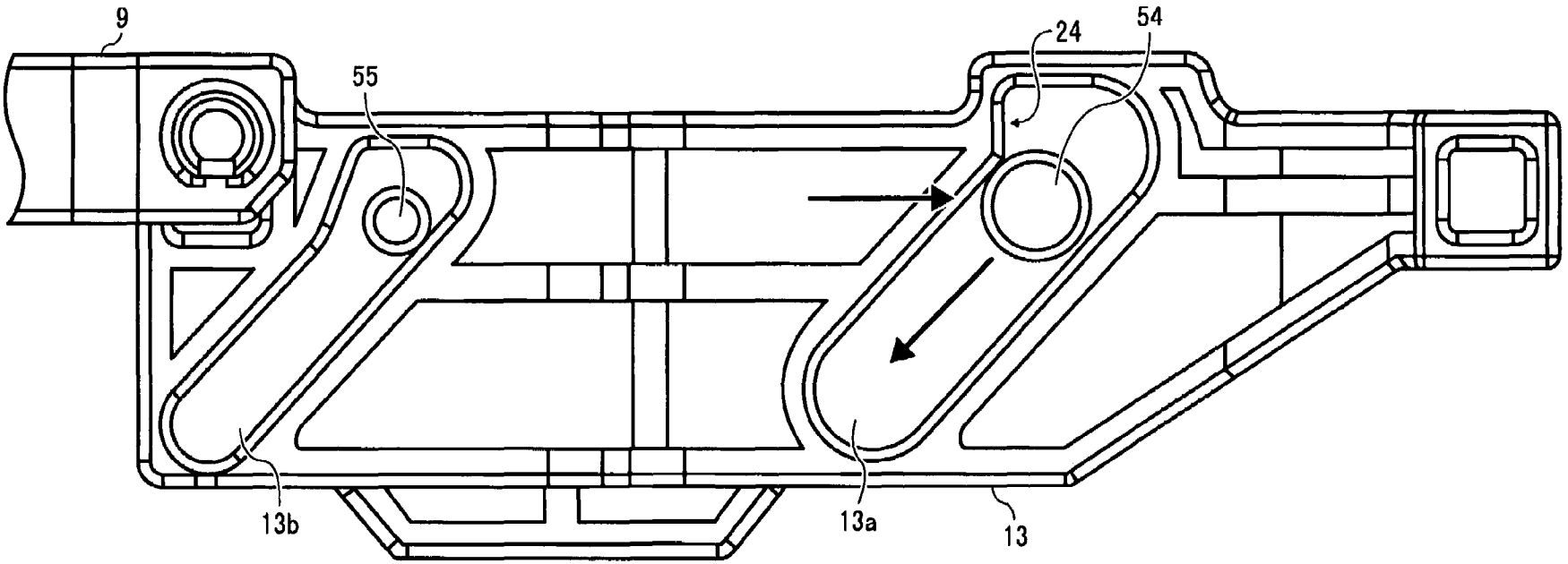
FIG. 39 illustrates an operation in which a shaft member of the hook assembly is moved down.

When the shaft 54 is detached from the vertical portion 24 of the inclined groove 13*a* (14*a*) as illustrated in FIG. 39, the back face of the hook 5 is pressed against an end face 1*a* of the pallet 2 as illustrated in FIG. 41. Then, the hook assembly 50 is moved down with the back face of the hook 5 guided by the end face 1*a*. When moved up from the position of the hook-storage state of FIG. 37, the hook assembly 50 is moved up with the back face of the hook 5 guided by the end face 1*a*. Accordingly, the hook 5 is substantially vertically moved up and down. Such configuration can reduce the size of hole (e.g., the hook insertion hole 102), through which the hook 5 is moved into and retreated from the article, into a minimum size, thereby effectively preventing the strength of the article from being reduced to a relatively low level.

After the hook 5 is moved into the article, the hook 5 or the hook assembly 50 is moved substantially horizontally as described above. Such configuration can set, to a relatively small size, the size of a space required for the movement of the hook 5 from when the hook 5 is moved into the article to when the article is fixed to the pallet. The same goes for when the hook 5 is retreated from the article-fix state to the exterior of the article. Accordingly, such configuration can keep, to a relatively small size, the size of the space provided in the article for the movement of the hook 5, thereby suppressing an increase in the size of article.

As described above, for the pallet 2 according to the fourth example embodiment, an article can be fixed and released with the article mounted on the article mount face of the pallet 2, thereby facilitating the packing and unpacking operations of the article. The upper faces of the hook 5 and the operation portion 7 are substantially leveled to the upper face of the pallet 2 in the hook-storage state. Accordingly, when an operator puts the article on or off the pallet 2, the hook 5 and the operation portion 7 do not interfere such operator's operation. In addition, when a plurality of pallets are stacked one on another during collection or storage, the hook 5 and the operation portion 7 do not interfere such stacking operation, thereby allowing a space required for collection or storage to be reduced. Furthermore, such configuration can prevent the hook 5 and the operation portion 7 from being damaged. In particular, when the pallet is transferred by a cargo-handling machine such as a forklift, such configuration can prevent, for example, a fork inserted to the fork insertion openings from abutting the hook 5 and the operation portion 7, thereby preventing the hook 5 and the operation portion 7 from being damaged. It should be noted that the hook 5 and the operation portion 7 may be provided so that, in the hook-storage state, the upper faces of the hook 5 and the operation portion 7 are positioned relatively lower than the upper face of the pallet 2 or the upper faces of the hook 5 and the operation portion 7 are depressed from the upper face of the pallet 2.

In the fourth example embodiment, the operation portion 7 has the lock member 72 so that the fixing device 10 is held at the article-fix state and the hook-storage state by the lock member 72. Such lock mechanism can prevent the fixed state of the hook 5 from loosening due to vibration or shock during transport or collection, thereby also preventing the hook 5 from losing its fixing force against the article. Further, such lock mechanism can prevent the hook 5 from projecting from the upper face of the pallet 2 during collection, thereby also preventing the hook 5 from being damaged.

Figure 44:
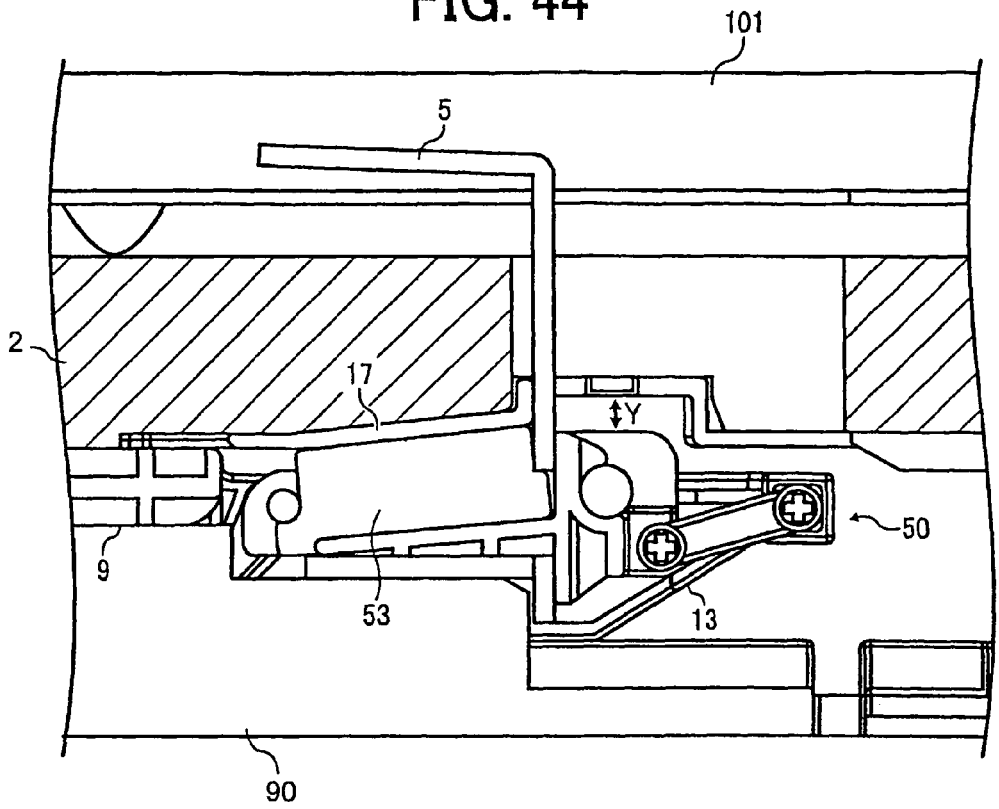
FIG. 44 is an illustration for explaining a buffering action of the hook assembly at the article-fix position.

As described above, the hook assembly 50 has the hook 5, the hook fix plate 51, the shaft fix member 52, the buffer member 53, the larger shaft 54, and the smaller shaft 55. When the hook assembly 50 is stored into the holder 90 via the guide members 13 and 14, the hook assembly 50 is covered with the cover member 17 from above. As indicated by a double arrow "Y" in FIG. 44, the hook assembly 50 and the guide members 13 and 14 are slightly movable in a substantially vertical direction at the article-fix position. When the hook assembly 50 is moved from the hook-storage position to the article-fix position, the buffer member 53 abuts against the lower face of the cover member 17, thereby preventing the hook assembly 50 from being vertically shaken. In such case, the buffer member 53 may be slightly compressed, and the guide members 13 and 14 are held by the pad members 18.

If the hook 5 is pulled upward via the article due to vibration or shock during transport, the hook assembly 50 and the guide members 13 and 14 are pulled upward. At this time, the buffer member 53 and the pad members 18 of FIG. 32 are elastically deformed to absorb such shock. Thus, when the hook 5 is pulled by a bounce of the article mounted on the pallet due to such vibration or shock during transport, the amount of load applied to the hook 5, the hook assembly 50, and/or the article base 101 can be reduced, thereby preventing the hook 5, the hook assembly 50, and/or the article base 101 from being damaged.

Figure 45:
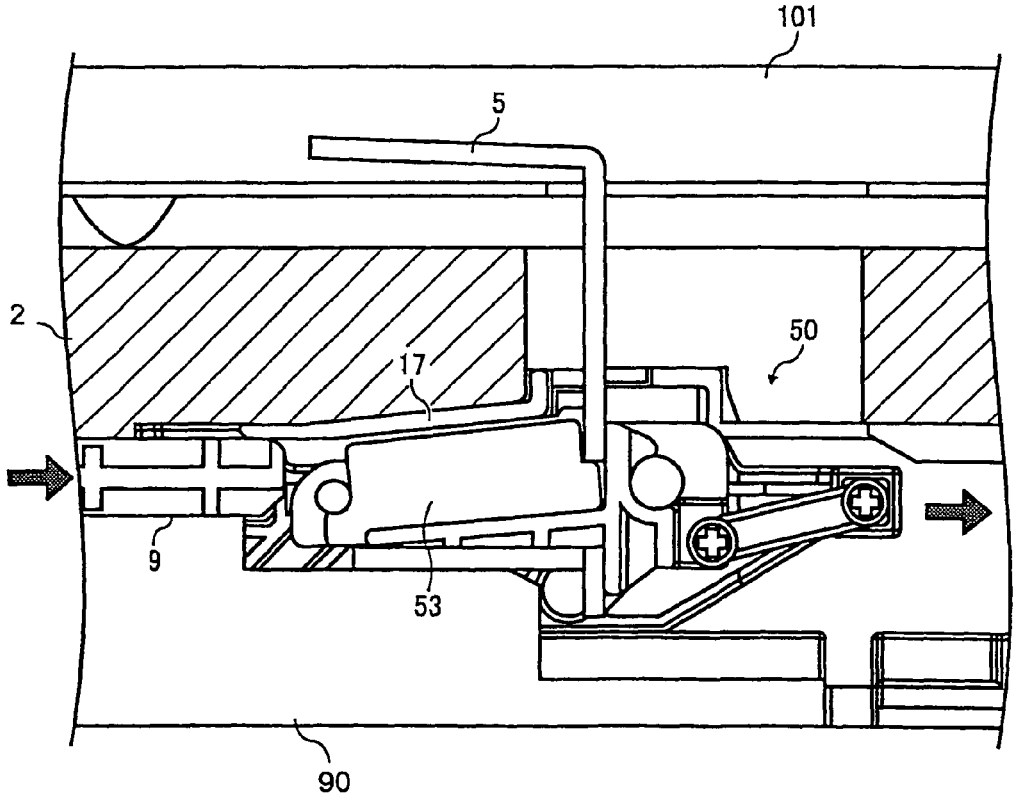
FIG. 45 is an illustration for explaining an operation conducted when releasing the fixation of the article from the article-fix state.

The contact face between the buffer member 53 and the cover member 17 forms a slant face opened toward the interior of the pallet 2, that is, toward the direction in which the fixation of the article is released. As a result, a slide load (or a load due to friction) generated when the fixation of the article is released can be reduced, thereby reducing a force required for operating the fixing device 10. For example, when releasing the article from the article-fix state, when the connector 9 is pushed by the operation lever 71 toward the interior of the pallet as indicated by a bold arrow in FIG. 45, the hook 5 or the hook assembly 50 is moved in parallel with the article mount face (horizontally in the present example embodiment). In such case, as described above, the contact face between the buffer member 53 and the cover member 17 forms the slant face opened toward the operating direction in which the fixation of the article is released. Accordingly, with a movement of the hook assembly 50, the buffer member 53 and the cover member 17 are relatively easily detachable from each other, thereby allowing the fixing device 10 to be operated with a relatively small force.

If the buffer member 53 and the cover member 17 were horizontally disposed so as to contact with each other, the hook assembly 50 would have to be horizontally moved without changing the contact state between the buffer member 53 and the cover member 17, that is, with a frictional force acting therebetween. By contrast, in the fourth example embodiment, the buffer member 53 and the cover member 17 are detached from each other just after the hook assembly 50 starts to move. Such configuration can prevent a frictional force from being generated between the buffer member 53 and the cover member 17, thereby allowing the fixing device 10 to be operated with a relatively small force. For example, if the hook 5 were accidentally hooked on to the article base 101 during transport, the article might be delivered to a destination with an upward load applied to the hook 5. In such case, because the buffer member 53 is sandwiched from above and below, the operation lever 71 might need to be operated with a relatively large force to release the fixation of the article to the pallet. By contrast, with the above-described configuration of the fourth example embodiment, such releasing operation can be conducted with a relatively small force, thereby facilitating unloading or unpacking operation of the article.

As described above, the vertical portion 24 is provided at each of the upper end portions of the inclined grooves 13*a* and 14*a* formed at the guide members 13 and 14, respectively, thereby allowing the hook assembly 50 to be relatively smoothly moved in a substantially horizontal direction. If only the inclined grooves were provided to the guide members without the vertical portions 24, when pushing the guide members 13 and 14 to move the larger shaft 54, the slant face would press the larger shaft 54, thereby applying a downward force as well as a force toward the horizontal direction to the larger shaft 54. Further, when the larger shaft 54 were pushed downward, the hook assembly 50 might be pressed against the holder 90. As a result, the guide members 13 and 14 might be pushed upward by a reaction force to be pressed against the cover member 17 and the pad members 18. In such case, the hook assembly 50 and the guide members 13 and 14 might be prevented from smoothly moving in the substantially horizontal direction. By contrast, because in the present example embodiment the vertical portions 24 are provided to each of the upper end portions of the inclined grooves 13*a* and 14*a*, the larger shaft 54 can be prevented from receiving a force in the vertical direction, allowing the larger shaft 54, the hook assembly 50, and the guide members 13 and 14 to be relatively smoothly moved in the substantially horizontal direction.

As illustrated in FIG. 34, the connector 9 is connected to the guide members 13 and 14 via the pivot shafts 9*a* and 9*b*. At the guide members 13 and 14 are provided the shaft fitting portions 13*d* and 14*d* for receiving the pivot shafts 9*a* and 9*b*. The height of each of the shaft fitting portions 13*d* and 14*d* is set to a value larger than a total value of the height of each of the pivot shafts 9*a* and 9*b* plus a deformation amount of the buffer member 53. Accordingly, in the above-described configuration in which the connector 9 is disposed between the main body of the pallet and the holder 90, when the hook 5 receives an external force, the guide members 13 and 14 are vertically moved, thereby allowing the buffer member 53 to absorb the external force.

As illustrated in FIG. 33, the hook 5 is a L-shaped member formed by the article fixing portion 5*a* and an erection portion 5*b*. As illustrated in FIG. 35, the erection portion 5*b* is in a substantially upright position while the article fixing portion 5*a* is oriented slightly upward relative to the horizontal direction. Accordingly, even if a contact portion of the article base 101 between it and the hook 5 is deformed, such configuration can prevent the front end portion of the hook 5 from being unintentionally hooked on to such deformed portion. Accordingly, the hook 5 is relatively smoothly movable to the article fixing portion, thereby preventing a failure from occurring in the fixation of the article to the pallet.

Figure 46:
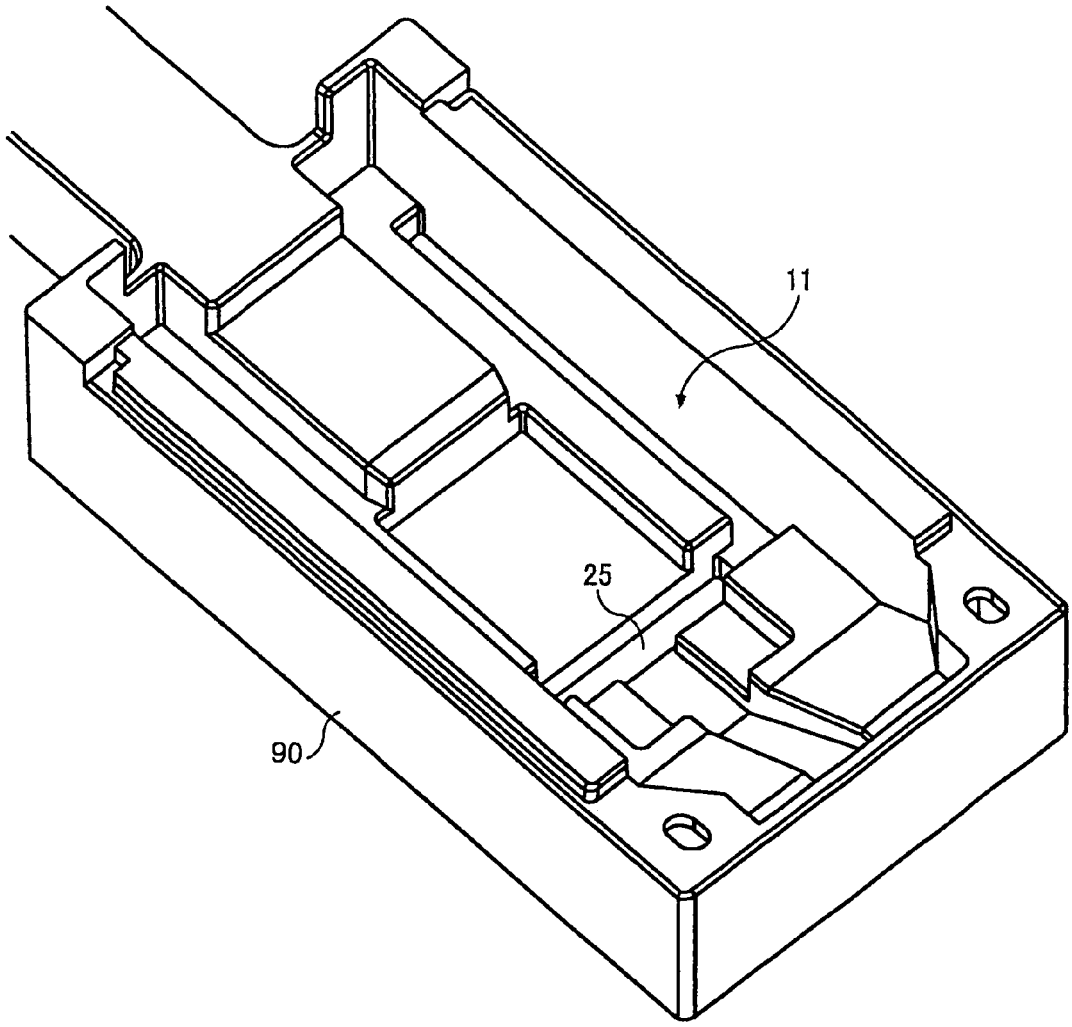
FIG. 46 is a perspective view illustrating a holder member and a drain opening formed therein.

As illustrated in FIG. 46, on a bottom portion of the holder 90 is formed a drain opening 25 to communicate the interior (the hold portion 11) and the exterior of the holder 90. Accordingly, even if water flows into the holder 90 during transport or storage, such water can be drained from the drain opening 25, thereby preventing dust from absorbing such water, adhering to surrounding members, and obstructing operations of the such members. In the fourth example embodiment, the drain opening 25 has a shape and size capable of fitting with a lower end portion of the hook 5. Accordingly, the drain opening 25 is also used as an escape portion for the lower end portion of the hook 5 when the hook assembly 50 moves downward at the hook-storage state. Such configuration can reduce the thickness of the holder 90 and the height of the pallet.

Next, a description is given of a packing unit according to a fifth example embodiment.

Figure 47:
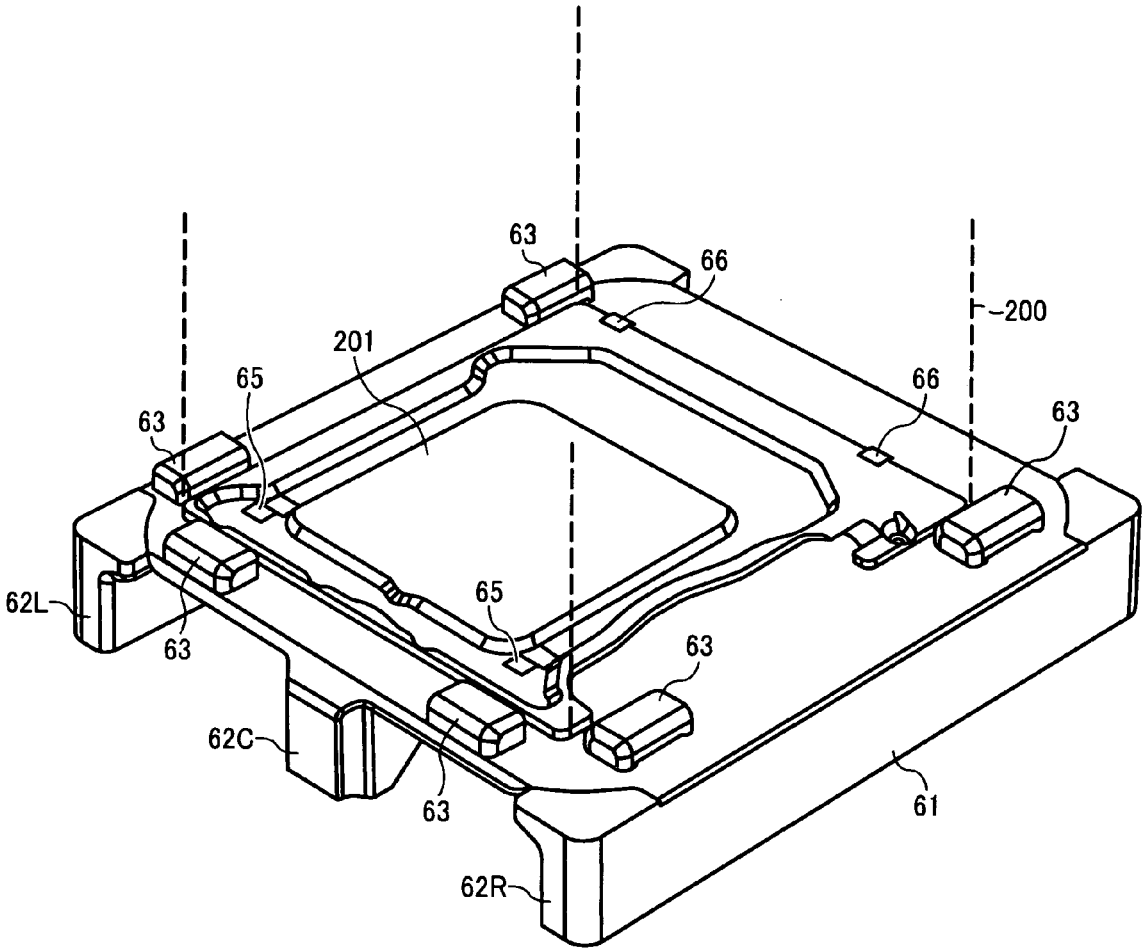
FIG. 47 is a perspective view illustrating a packing unit according to a fifth example embodiment and a portion of an article.

FIG. 47 is a perspective view illustrating the packing unit according to the fifth example embodiment together with an article 200.

As illustrated in FIG. 47, the packing unit according to the fifth example embodiment is configured as a pallet 61 to mount the article 200 thereon. The pallet 61 has a left beam 62L, a central beam 62C, and a right beam 62R at its left-end, middle, and right-end portions, respectively. Between the three beams 62L, 62C, and 62R are formed insertion openings into which a fork of a forklift is insertable. On the pallet 61 are provided four hooks serving as fixing devices to fix the article onto the pallet. More specifically, on a front side of the pallet 61 are provided two hooks 65 serving as a movable fixing device while on a rear side of the pallet 61 are provided two stationary hooks 66 serving as a stationary fixing device. On the pallet 61 are also provided a plurality of positioning members 63 to position an article on the pallet 61. In FIG. 47, the six positioning members 63 are mounted on the pallet 61: two of the six positioning members 63 are disposed so as to contact the front face of the article 200 and the other four are disposed so as to contact the side faces of the article 200. The positioning members 63 are detachably mounted on the upper face of the pallet 61. Preferably, the main body of the pallet 61 and the positioning members 63 include a resin material such as PP (polypropylene) or PE (polyethylene) in view of cost, weight, and so on.

Figure 48:
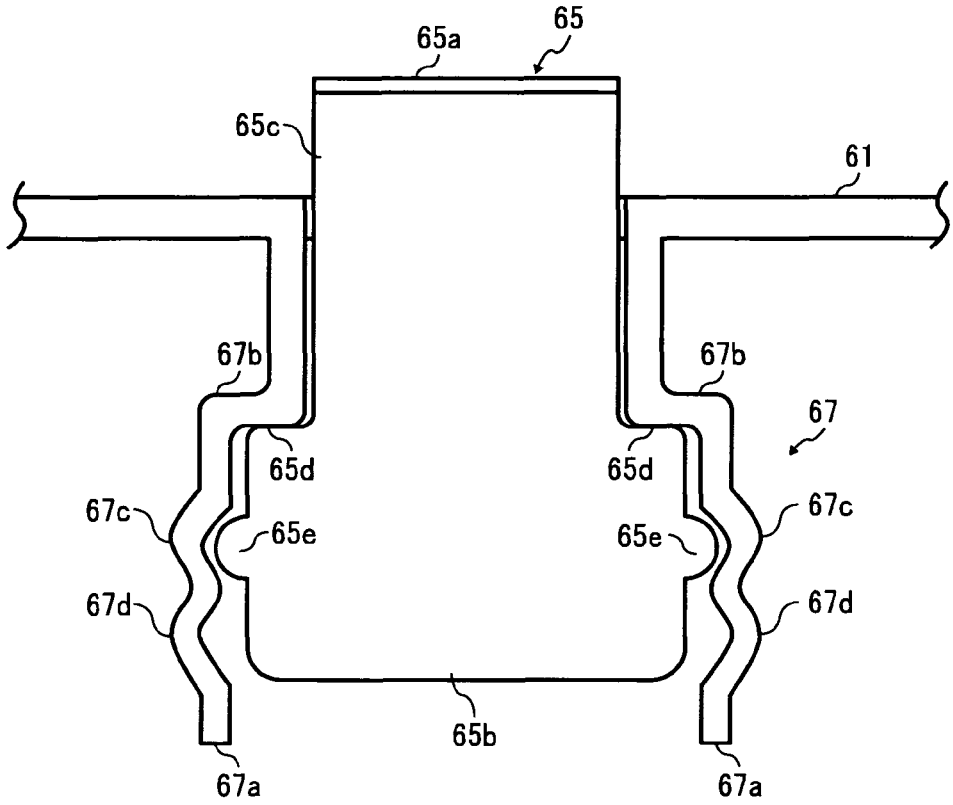
FIG. 48 is a partial sectional view illustrating a movable hook and a hook fitting portion of the pallet of FIG. 47.

FIG. 48 is a partial sectional view illustrating a configuration of the movable hooks 65 of the pallet 61. Each movable hook 65 has an article fixing portion 65*a* to contact an article base 201 to fix the article 200, a fitting portion 65*b* to fit with the main body of the pallet 61 to support the hook 65, and a connecting portion or perpendicular portion 65*c* to connect the article fixing portion 65*a* and the fitting portion 65*b*. The fitting portion 65*b* has a width larger than a width of the perpendicular portion 65*c*, and a shoulder portion 65*d* is formed at a border portion between the fitting portion 65*b* and the perpendicular portion 65*c*. On both sides of the width direction of the fitting portion 65*b* are formed semicircular convex portions 65*e*.

On the pallet 61 is provided a hook fitting portion 67 to which the movable hook 65 is fitted. The hook fitting portion 67 has a lower end portion 67*a* formed as a free end portion, and is capable of fitting and supporting the hook 65 by elasticity of a resin material. The hook fitting portion 67 has a wider portion and a narrower portion corresponding to the shape of the hook 65 and a shoulder portion 67*b* between the wider and narrower portions. The wider portion has concave portions 67*c* and 67*d* fittable with the convex portions 65*e*.

When the hook 65 is inserted to the pallet 61 to fit the convex portion 65*e* with the upper concave portions 67*c* of the hook fitting portion 67, the hook 65 is fixed to an article fixing position in which the article fixing portion 65*a* of the hook 65 is projected from the upper face of the pallet 61. Further, by fitting the convex portions 65*e* to the lower concave portion 67*d*, the hook 65 is fixed to a hook-storage position in which the upper face of the article fixing portion 65*a* is leveled or depressed relative to the upper face of the pallet 61. Preferably, a protector made of a material, such as POM (polyoxymethylene), having a relatively excellent slidability is provided at the hook fitting portion 67 of the pallet 61. In the hook 65, preferably, the convex portions 65*e* may be a boss member made of POM or any other suitable member in view of durability. Although not illustrated, a hole or recess may be formed in the main body of the pallet 65 so that the upper face of the article fix portion 65*a* of the hook 65 is leveled or depressed relative to the upper face of the pallet 65.

Next, a description is given of an operation in which the article 200 is mounted onto the pallet 61.

Figure 49:
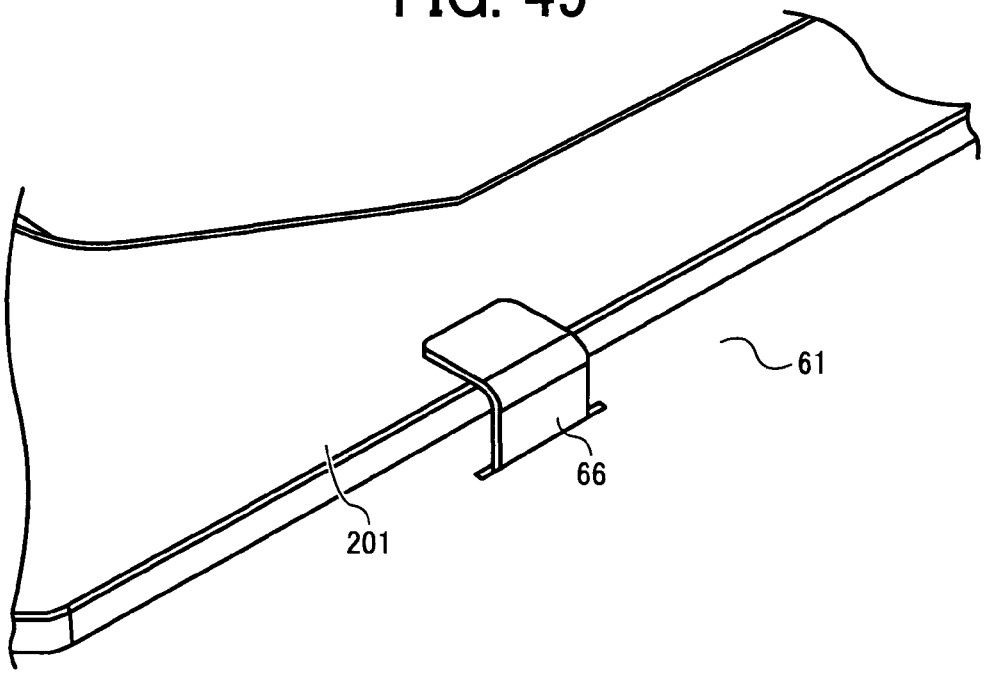
FIG. 49 is a perspective view illustrating a state in which an article base is fitted with a stationary hook.
Figure 50:
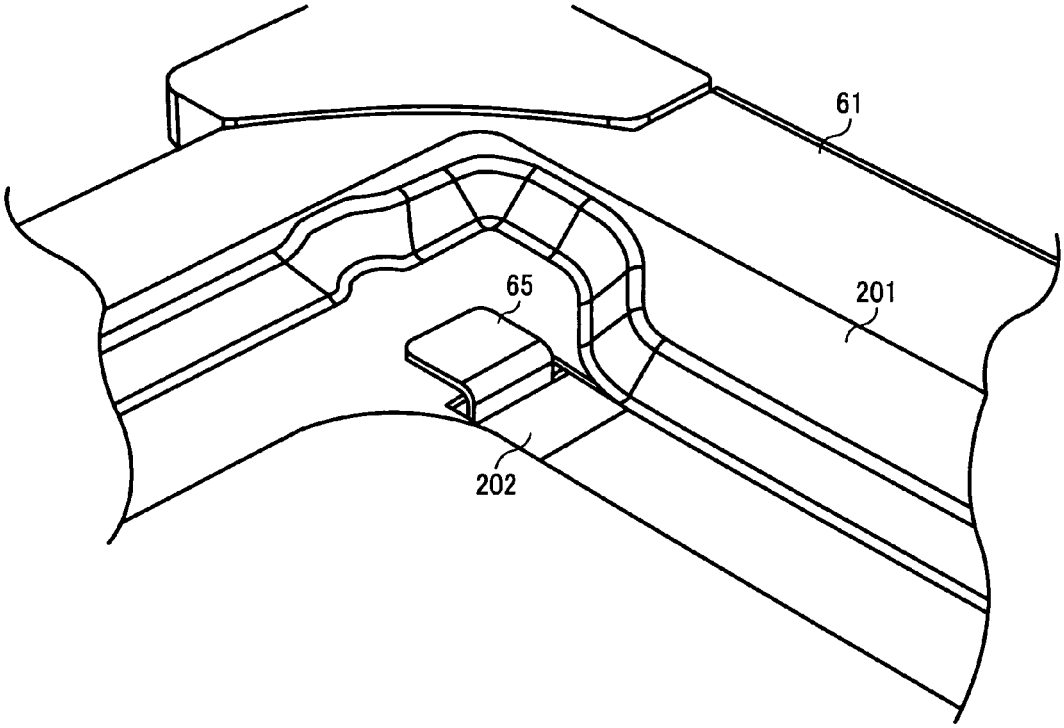
FIG. 50 is a perspective view illustrating a state in which the movable hook is fitted with the article base.

During packing or unpacking operation, the article 200 is loaded or unloaded onto the pallet 61 with the positioning members 63 detached from the pallet 61. Further, each movable hook 65 is fixed to the article fixing position. In such state, the article 200 is mounted onto the pallet 61 so that each hook insertion hole 202 formed at the article base 201 is fitted with the corresponding movable hook 65 as illustrated in FIG. 50. Then, the article 200 mounted on the pallet 61 is slid toward the rear side of the pallet 61 so that, as illustrated in FIGS. 49 and 50, the article base 201 is fitted with the movable hooks 65 and the stationary hooks 66. When the positioning members 63 are attached to the predetermined positions on the pallet 61, the loading or packing operation of the article 200 is finished. The unpacking operation is performed in a sequence opposite to the above-described sequence.

In the pallet 61 according to the fifth example embodiment, each of the stationary hooks 66 provided on the rear side of the pallet 61 is hooked on to an end portion of the article base 201. Accordingly, no holes for the stationary hooks 66 need to be formed at the article base 201, and it may be sufficient to form only cutout portions having a size corresponding to the height of the stationary hooks 66 at an exterior cover of the article 200. As a result, the depth dimension of the stationary hooks 66 can be extended without depending on the article size, allowing the strength against a shock in the horizontal direction to be relatively easily increased. Accordingly, among the positioning members 63 disposed around the article, the positioning members 63 on the rear side of the pallet may be omitted.

In order to reduce the size of the hook insertion hole formed at the article base 201 and/or the size of an escape portion formed at an exterior portion of the article, it is preferable to reduce the dimensions of the hooks 65 and 66. Therefore, preferably the movable hooks 65 and the stationary hooks 66 are made of metal, more preferably, stainless in view of environmental conditions in which the pallet is used. Further, preferably the positioning members 63, disposed in an outer peripheral portion of the article mount face of the pallet, are made of resin material. More preferably, the positioning members 63 is made of a crystalline resin having a relatively great mechanical strength so as to be resistant to a repeated shock during transport. In particular, PP and PE are preferable in view of cost.

Figure 51:
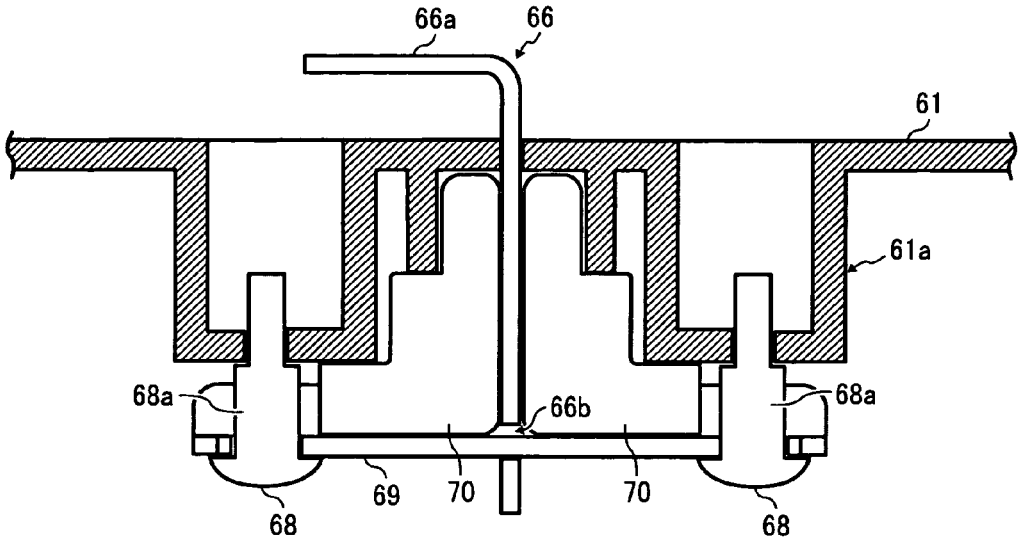
FIG. 51 is a partial sectional view illustrating a configuration of the stationary hook and the hook fitting portion.

FIG. 51 is a partial sectional view illustrating a configuration of the stationary hook 66 of the pallet 61.

Figure 52:
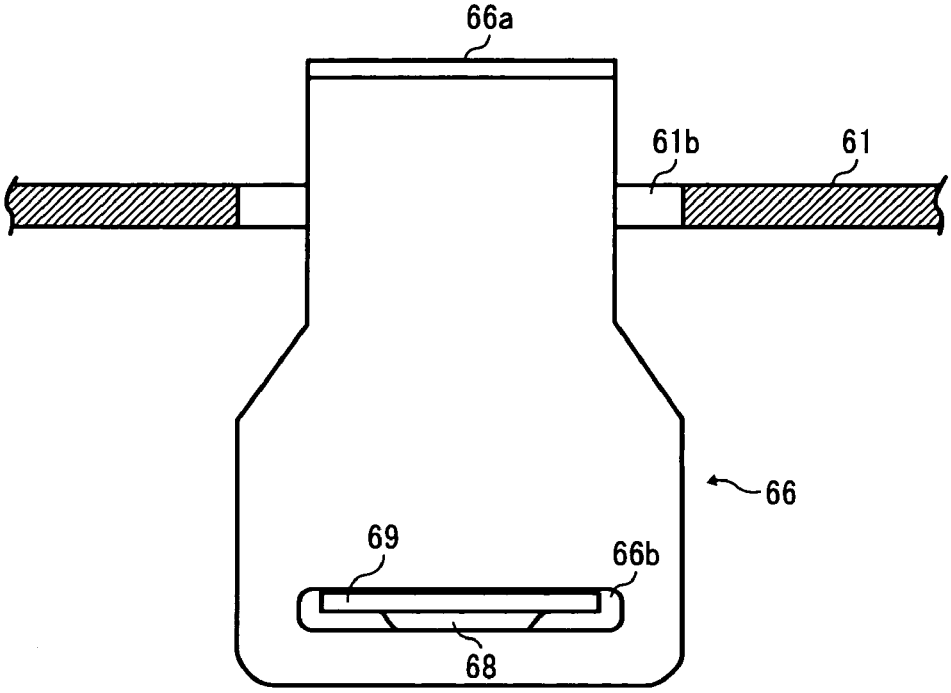
FIG. 52 is a back view of the stationary hook.

FIG. 52 is a sectional view of the stationary hook 66 seen from the right side of FIG. 51.

As illustrated in FIGS. 51 and 52, cushioning members 70 are held against a hook fitting portion 61*a* provided at the pallet 61 by screwing a hook hold member 69 with shoulder screws 68. The stationary hook 66 is disposed so as to be sandwiched between the cushioning members 70. At a vicinity of a lower end portion of the stationary hook 66 is a cutout hole 66*b* into which the hook hold member 69 is inserted. Through the hook hold member 69, wider shaft portions 68*a* of the shoulder screws 68 are movable substantially vertically or in the axial directions of the shoulder screws 68. An article fixing portion 66*a*, that is, an upper face of the stationary hook 66 is projected from the upper face of the pallet through a hole 61*b* formed at the pallet. Thus, each stationary hook 66 is held via the cushioning members 70 by the hook fitting portion 61 provided to the pallet 61.

Figure 53:
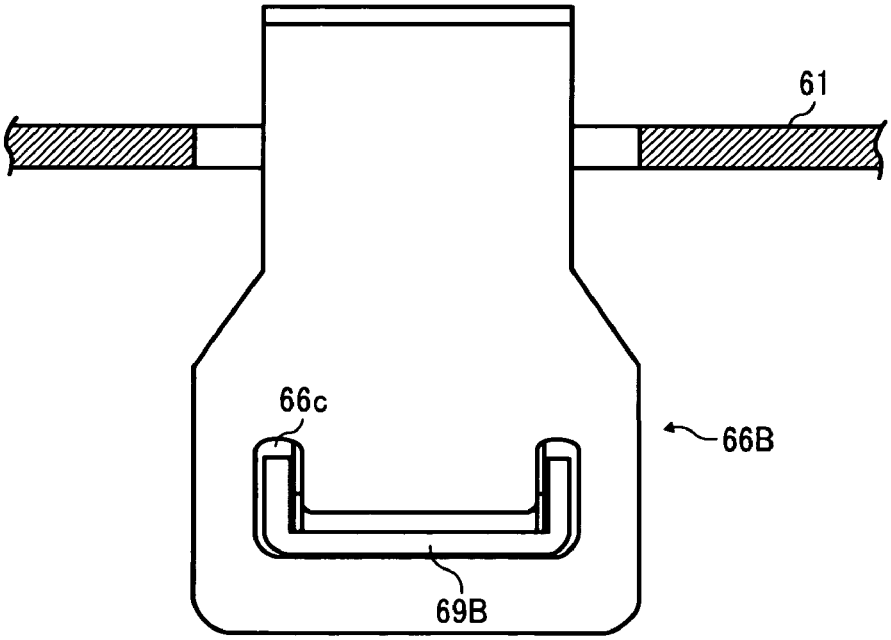
FIG. 53 is a back view of a variation example of the stationary hook.

FIG. 53 illustrates a stationary hook 66B according to a variation example in which a hook hold member 69B having a substantially U-shape is used as the hook hold member that are pressed against the cushioning members 70. The stationary hook 66B has a configuration similar to the configuration of the stationary hook 66 illustrated in FIGS. 51 and 52 except that the hook hold member 69 having a flat shape is replaced with the hook hold member 69B having a substantially U-shape and accordingly the cutout hole 66*b* formed at the stationary hook 66 is replaced with a cutout hole 66*c* having a substantially U-shape. The operation of the stationary hook 66B is similar to the operation of stationary hook 66 described for FIGS. 51 and 52, and therefore redundant descriptions are omitted below.

If an article bounces due to vibration or shock during transport, the article fixing portion 66*a* is pulled up by the article base 201 fitted with the stationary hooks 66 (66B) as illustrated in FIGS. 47 and 49. In such case, because each hook hold member 69 (69B) is movable substantially vertically along the wider shaft portions 68*a* of the shoulder screws 68, each hook hold member 69 (69B) is pressed against the cushioning members 70 via the corresponding stationary hook 66 to absorb the force pulling the stationary hook 66 upward. Alternatively, even when the stationary hook 66 receives a load from a horizontal direction, the cushioning members 70 can prevent an upper portion of the stationary hook 66 from being shaken. Thus, each of the stationary hooks 66 can be held by the pallet 61 via the cushioning members 70, thereby reducing a load applied to the stationary hooks 66 or the article base 201 during transport.

Further, because the hook hold member 69 (or 69B) is movable along the shoulder screws 68, a time in which a shock is applied to the stationary hooks 66 during transport can be extended so as to cushion the impact of the shock. As described above, the hook hold member 69 (or 69B) is relatively freely movable, thereby allowing a cushioning effect of the cushioning members 70 to be effectively obtained.

Figure 54:
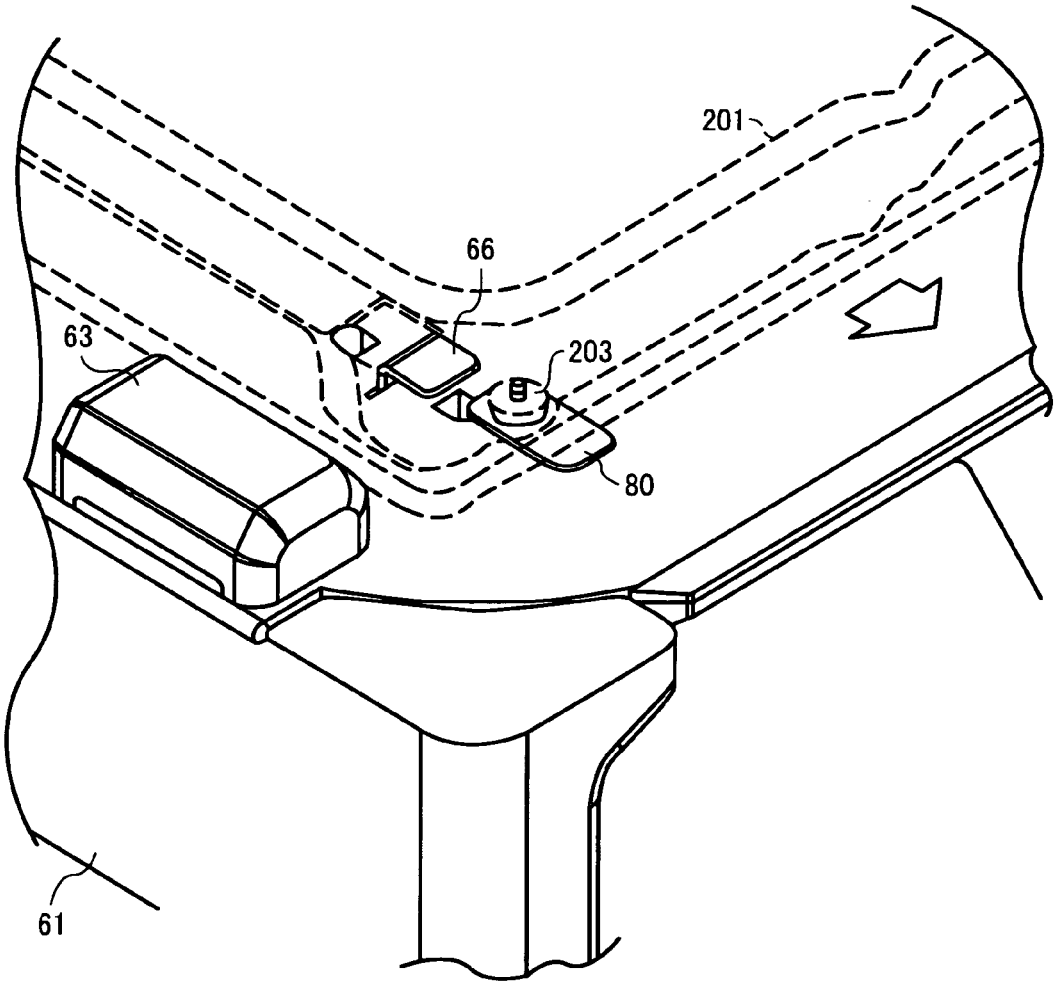
FIG. 54 is a partial perspective view illustrating a slidable member provided to an upper face of the pallet.

FIG. 54 is a partial perspective view illustrating a slidable member 80 provided on the upper face of the pallet 61. As illustrated in FIG. 54, the slidable member 80 is attached at a portion close to the stationary hook 66 on the upper face of the pallet 61. Preferably, the slidable member 80 is made of a member having relatively high slidability and rigidity. The slidable member 80 may be attached on the pallet 61 with glue or adhesive or in any other suitable manner. Preferably the slidable member 80 is disposed at a portion anterior to the stationary hook 66, that is, in a direction toward which the article fix portion 66*a* is opened. It should be noted that, although the stationary hook 66 is described above, the slidable member 80 may be disposed close to each movable hook 65.

To fix or unfix an article with the hooks 65 and 66, the article needs to be moved over the pallet 61, for example, in a direction indicated by an arrow in FIG. 54. Consequently, if irregularity is generated on the article mount face due to repeated use of the pallet, a relatively great force may need to move the article, thereby resulting in a reduction in workability. Hence, as described above, according to the fifth example embodiment, the slidable members 80 made of a material having relatively high slidability and rigidity are attached to the upper face of the pallet. In such configuration, by moving foot portions 203 of the article over the slidable members 80, the article can be relatively easily moved, thereby facilitating packing and unpacking operations.

It should be noted that example embodiments according to the present invention are not limited to the above-described example embodiments. For example, any suitable number of fixing devices may be disposed on the pallet, and such fixing devices may be disposed at any suitable points on the pallet. Further, the shape or the movable distance of the hooks may be set to any suitable shape or distance.

Further, as described above, the packing unit may have supports, side plates, and a top in addition to the pallet. A product or article loaded on the packing unit is not limited to an image forming apparatus but may be any other suitable product or article.

Still further, elements and/or features of different example embodiments may be combined with each other and/or substituted for each other within the scope of this disclosure and appended claim.

Examples and embodiments being thus described, it should be apparent to one skilled in the art after reading this disclosure that the examples and embodiments may be varied in many ways. Such variations are not to be regarded as a departure from the spirit and scope of the present invention, and such modifications are not excluded from the scope of the following claims.

What is claimed is:

1. A packing unit comprising:

a pallet having an article mount face to mount an article thereon; and a fixing device to fix the article to the pallet, the fixing device including a fixing member opposing a structural bottom base of the article and formed in a hook shape to be engageable with a fixed portion of the structural bottom base of the article to fix the article to the pallet, and a moving mechanism to move the fixing member between an article fix position at which the fixing member is engaged with the fixed portion and a storage position at which the fixing member is stored in the pallet, wherein the moving mechanism projects the fixing member from the pallet and moves the fixing member substantially parallel to the article mount face of the pallet to shift the fixing member to the article fix position, wherein the pallet has a setting portion, wherein the fixing device further includes an assembly and a guide member, the assembly having the fixing member, and wherein the moving mechanism has a holder member to hold the assembly movable substantially parallel to the article mount face via the guide member, an operation member slidable substantially parallel to the article mount face within the setting portion of the pallet, and a connector to connect the assembly and the operation member.

2. The packing unit according to claim 1, wherein the fixing member further includes an article engage portion engageable with the fixed portion, and wherein the article engage portion forms an elevation angle relative to a direction to fix the article.

3. The packing unit according to claim 1, wherein the fixing member is disposed so as not to project from an upper face of the pallet at the storage position.

4. The packing unit according to claim 1, further comprising a lock member capable of holding the fixing member at the article fix position and the storage position, wherein the lock member locks the operation member at one end portion in a slidable range of the operation member to hold the fixing member at the article fix position and locks the operation member at another end portion of the slidable range of the operation member to hold the fixing member at the storage position.

5. The packing unit according to claim 1, wherein the assembly further includes a buffer member disposed between the fixing member and the holder member and is movable substantially vertically at the article fix position, wherein, when the fixing member receives an upward load, the buffer member is elastically deformed to buffer the upward load.

6. The packing unit according to claim 1, wherein the assembly further includes a shaft member coupled with the fixing member, wherein the guide member has an inclined groove into which the shaft member is inserted to hold the assembly movable upward and downward, wherein the guide member has a pressing face at an upper end portion of the inclined groove, and wherein the pressing face extends substantially perpendicular to the article mount face and is configured to contact and press the shaft member in a direction to release the fixation of the fixing member to the pallet.

* * * * *